United States Patent [19]

Berté

[11] 4,326,475

[45] Apr. 27, 1982

[54] SAILBOAT

[75] Inventor: Frank J. Berté, Suffield, Conn.

[73] Assignee: Massachusetts Institute of Technology, Cambridge, Mass.

[21] Appl. No.: 20,905

[22] Filed: Mar. 16, 1979

[51] Int. Cl.[3] ..... B63B 35/00

[52] U.S. Cl. ..... 114/39; 114/61

[58] Field of Search ..... 114/39, 61, 43

[56] References Cited

U.S. PATENT DOCUMENTS

| | | | |
|---|---|---|---|
| 831,636 | 9/1906 | Suhm | 114/39 |
| 3,395,664 | 8/1968 | Greenberg et al. | 114/39 |
| 3,831,539 | 8/1974 | Black | 114/39 |

FOREIGN PATENT DOCUMENTS

| | | | |
|---|---|---|---|
| 2649577 | 5/1978 | Fed. Rep. of Germany | 114/41 |
| 2367653 | 6/1978 | France | 114/90 |

*Primary Examiner*—George E. A. Halvosa
*Assistant Examiner*—Jesús D. Sotelo
*Attorney, Agent, or Firm*—Arthur A. Smith, Jr.; Peter Manus

[57] ABSTRACT

A sailboat having a triangular frame formed of three beams forming the sides of that frame and three pontoons or hulls disposed at the vertices of the triangle and extending outward from one side of the plane of the triangle. A mast extends outward from the other side of the plane and is connected to the vertices by cables to form a tetrahedral-type space frame which is structurally sound and easily dismantled.

20 Claims, 41 Drawing Figures

DETAIL

SAILBOAT

The present invention relates to sailboats in the form of multiple-pontoon or multiple-hull structures.

By way of background, attention is called to a book entitled "Boating Facts and Feats" (Johnson), one of the Guiness Family of Books, Sterling Publishing Co. Inc., New York, New York, pp. 22–26.

Modern catamarans and trimarans are developments of the ancient proa which is composed of a single hull and one outrigger. The proa is built to sail with either end forward, and the sail is capable of being reversed (i.e., athwart-ship symmetry). The basic principle behind the proa's sailing capabilities lies in the fact that the turning moment generated by the wind on the sail is offset by the crew (live ballast) on the outrigger. This optimum weight distribution and shallow draft render the proa one of the fastest sailboats on the sea, for its size. The main disadvantage of the proa is the need, when in optimum configuration, to keep the outrigger to windward. This means that during a tacking maneuver the bow of the vessel must become the stern and the stern the bow. The sail plan must also be reversed to change from say, a port to a starboard tack.

The catamaran design was an attempt to solve the tacking problem of the proa by making the outrigger the same size as the main hull. One hull serves as the outrigger on one tack, while the other serves as the outrigger on the other tack. The shortcoming of this design relative to the proa is that, when the catamaran flies a hull, the hull remaining in the water must double its displacement; for the proa, when the outrigger is flying, the main hull displacement increase is almost negligible. This displacement problem of the catamaran causes almost complete submergence of the leeward hull in a small catamaran with a concurrent decrease in hull performance.

The trimaran design is yet another attempt to emulate the design features of the proa but avoid the tacking problem thereof. The trimaran utilizes two outriggers, one on either side of the main hull. The disadvantage of this design is that the leeward outrigger displacement is progressively increased as the capsizing moment of the wind on the sail increases. This in turn increases friction and wave drag forces. Furthermore, the two outriggers counter-balance each other and their weight only serves to increase the main hull displacement, and not offset the capsizing moment of the wind load on the sails.

The sailboat of the present invention solves the tacking problem of the proa yet the displacement of the hulls in the water increases only about thirty-three percent when the outrigger is flying, compared to a one hundred percent increase for the catamaran; and it has no extra hull, as does the trimaran, to increase drag when the boat heels over. Other facets of the sailboat of the present invention and differences and advantages over the proa, the catamaran, the trimaran are taken up later.

It is an object of the present invention to provide a sailboat with multiple pontoons or hulls, a sailboat which has the advantages of the proa, the catamaran and the trimaran, but without some of the inherent disadvantages in each of the earlier boats.

A further object is to provide a sailboat which can be disassembled for portability, and can be assembled with ease.

A still further object is to provide a sailboat which may be marketed in kit form and that is inexpensive to make, yet constitutes a sturdy, quickly assembled, and reliable structure.

A still further object is to provide a sailboat with a space frame structure, which minimizes structural stresses due to wind and sea loads.

A still further object is to provide the optimum stability possible for a given displacement sailboat, thus assuring the maximum safety and reliability.

A still further object is to provide the greatest sail area to weight ratio to allow getting out of the way of the weather, because of high speed capabilities.

A still further object is to provide a sailboat whose component parts are of comparable weights easily handled by one person (16-foot deck beam length).

A still further object is to provide a multi-hulled sailboat design which is not subject to pitchpoling.

A still further object is to provide a sailboat which is sea kindly and provides the most stable sailing platform possible under given wind and sea conditions.

A still further object is to provide a sailboat with the maximum deck area per unit displacement to assure the safety of the crew in changing and trimming the sails.

A still further object is to provide a sailboat which has the minimum windage losses for a given overall length.

A still further object is to provide a sailboat with the capability to alter its hull configurations to suit sailing conditions precisely.

A still further object is to provide a sailboat capable of utilizing the counterbalancing weight of the helmsman to the fullest extent possible, yet assure that all necessary controls are within his reach.

A still further object is to provide a sailboat which is extremely trimmable, via the use of dagger boards at each of the vertices.

A still further object is to provide a sailboat which can easily use its hulls in a planing mode even when flying a hull.

A still further object is to provide a sailboat whose hulls angles of incidence to the sea can be adjusted to suit sea conditions.

A still further object is to provide a sailboat which can be turned easily and quickly.

A still further object is to provide a sailboat which can ride over turbulence instead of plowing through it.

A still further object is to provide a sailboat which can alter its leeward resistance to suit sailing conditions.

Other objects are evident in the description that follows.

The foregoing objects are achieved, generally, in a sailboat that includes a rigid space frame that comprises three beams that form the sides of a triangle and a mast secured respectively at the top and bottom ends thereof to the vertices of the triangle by cables and disposed substantially orthogonal to the plane of the triangle. The lower end of the mast is disposed within the perimeter of the triangle and pierces the plane of the triangle. The cables are stretched to support the mast as well as to render the space frame rigid. Three pontoons or hulls are positioned respectively at the three vertices of the triangle and secured to the space frame at said vertices.

The invention is hereafter described with reference to the accompanying drawing in which:

FIG. 1 is an isometric view of a three-hulled sailboat of the present invention, sailing on a broad reach, said sailboat including a space frame;

FIGS. 2A, 2B, and 2C are respectively a top view, a side view, and an isometric view showing the space frame of the sailboat of FIG. 1;

Figure 1:
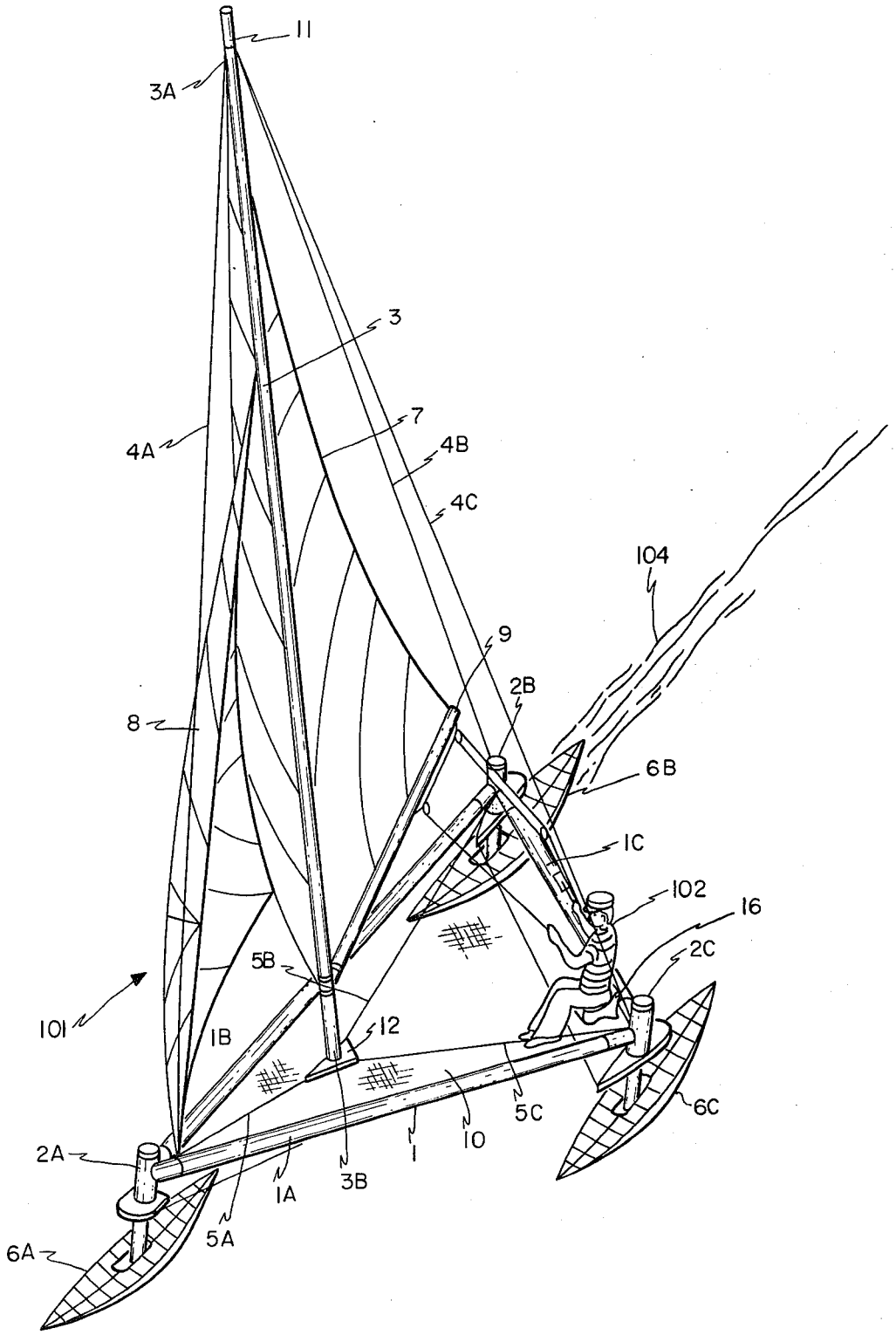
Figure 10C:
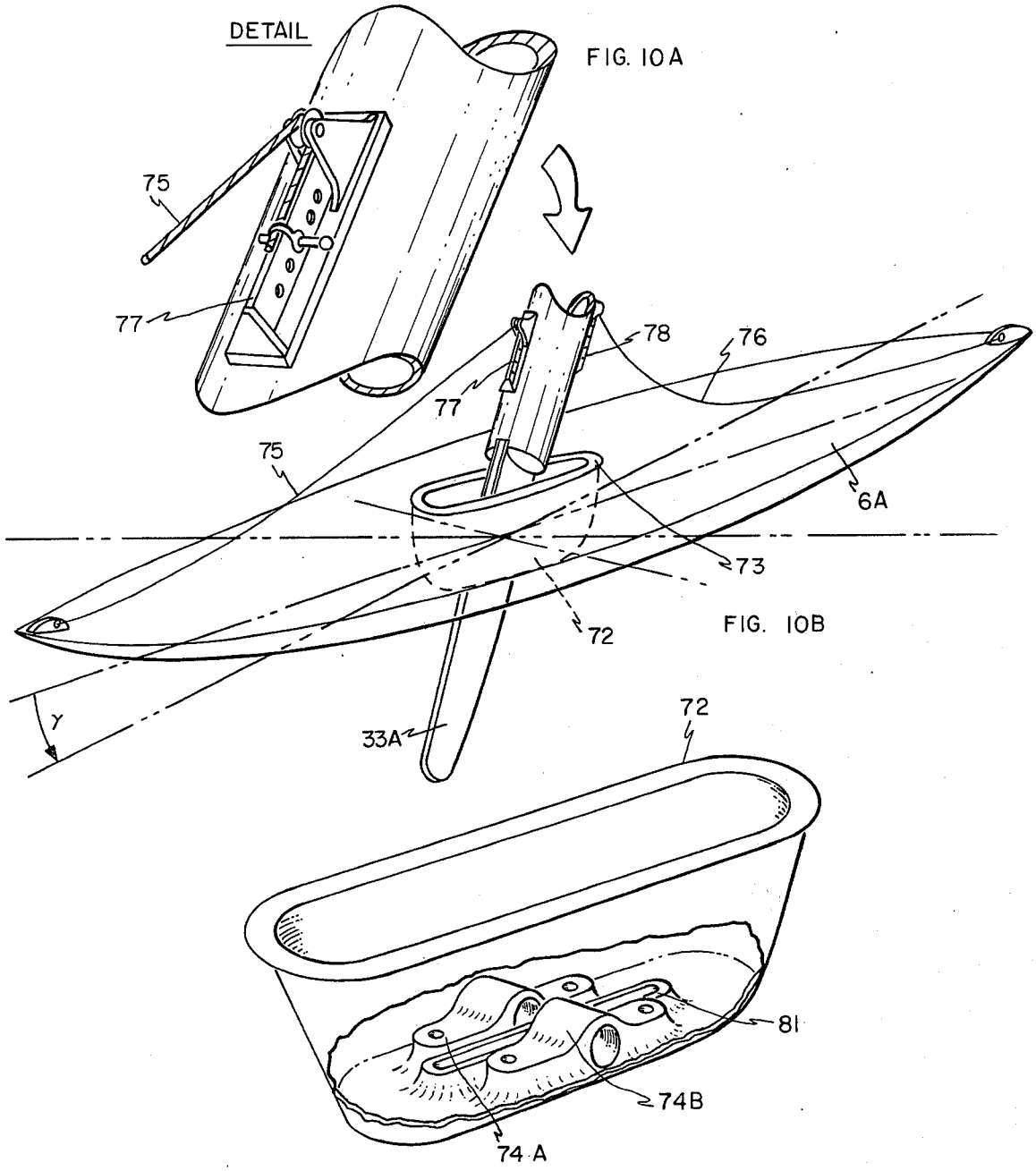
Figure 11A:
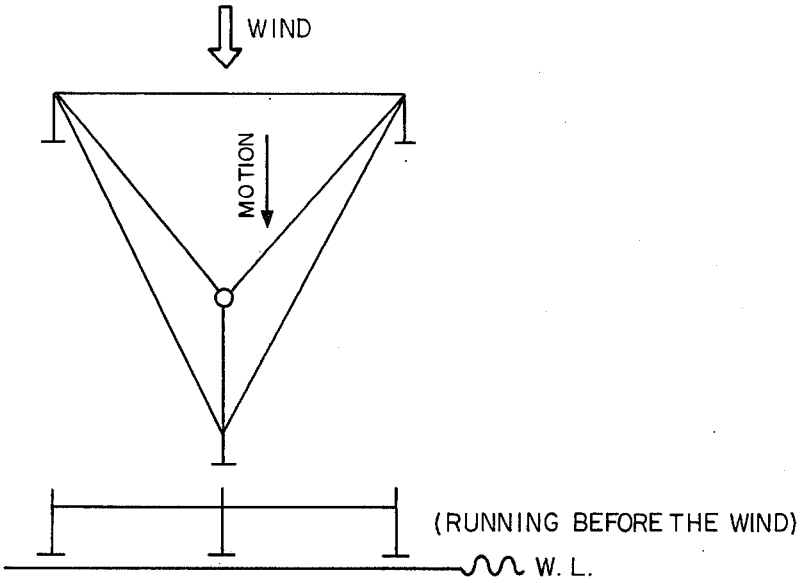
Figure 11B:
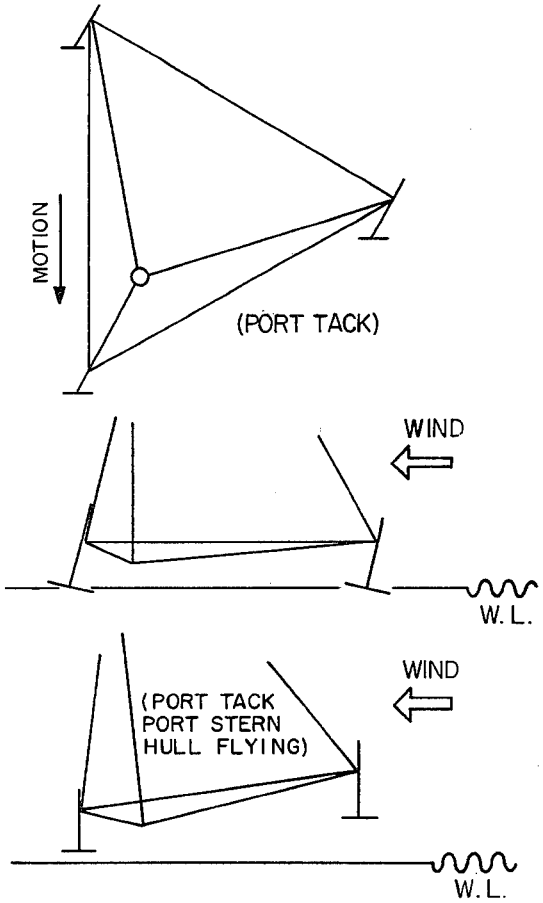
Figure 11C:
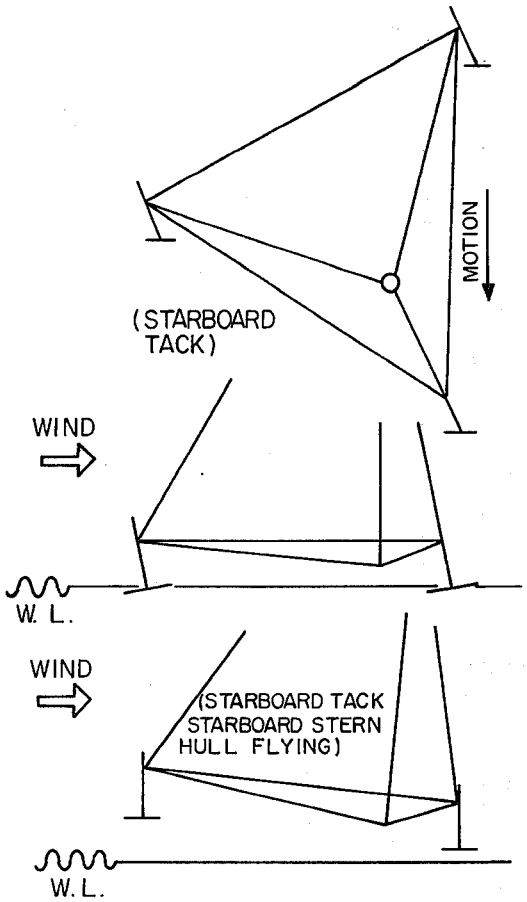
Figure 14A:
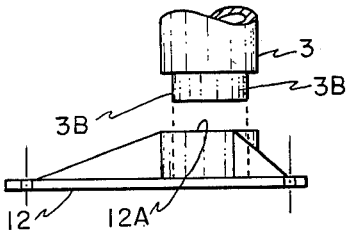
Figure 15A:
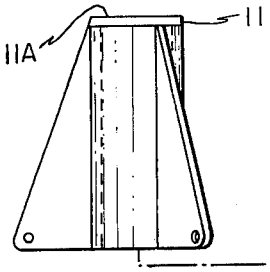
Figure 14B:
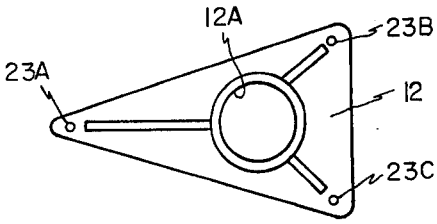
Figure 15B:
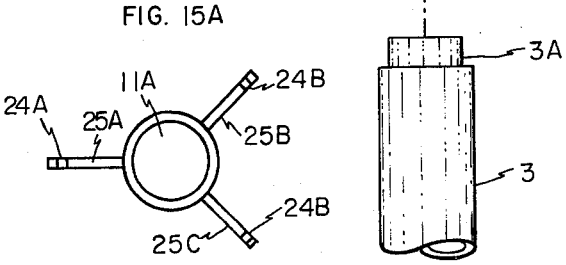
Figure 13D:
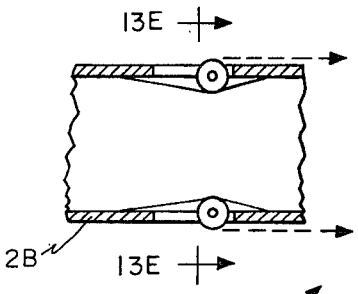
Figure 13E:
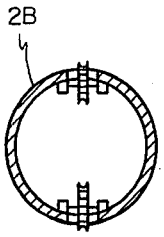
Figure 13A:
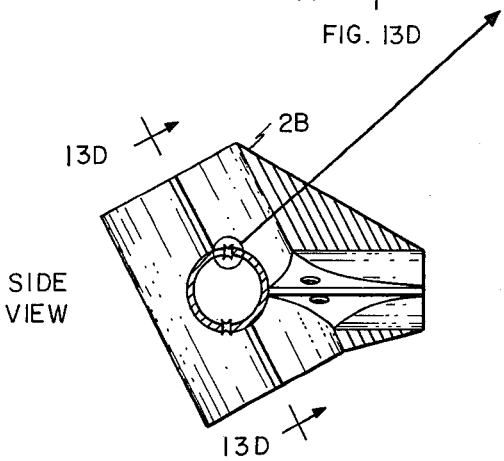
Figure 13B:
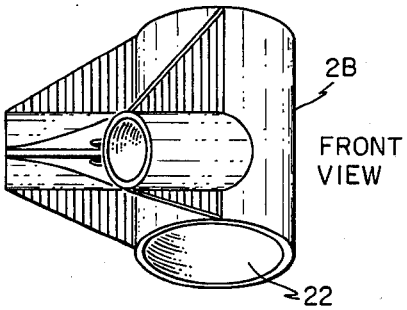
Figure 13C:
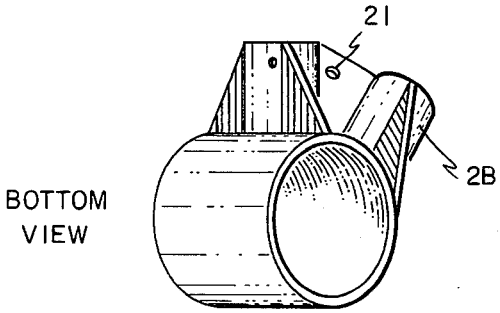
Figures 16A, 16B:
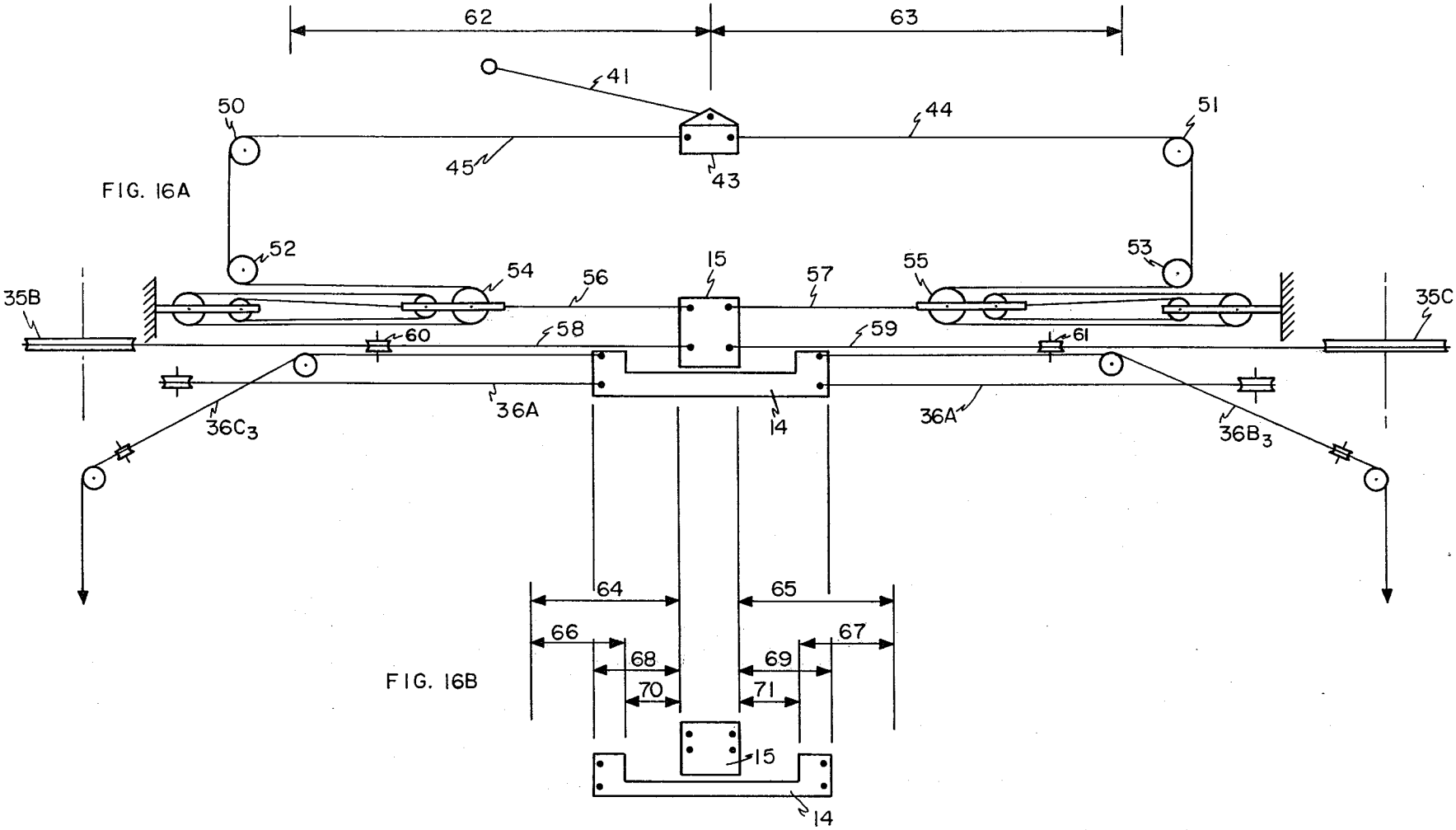
Figure 17:
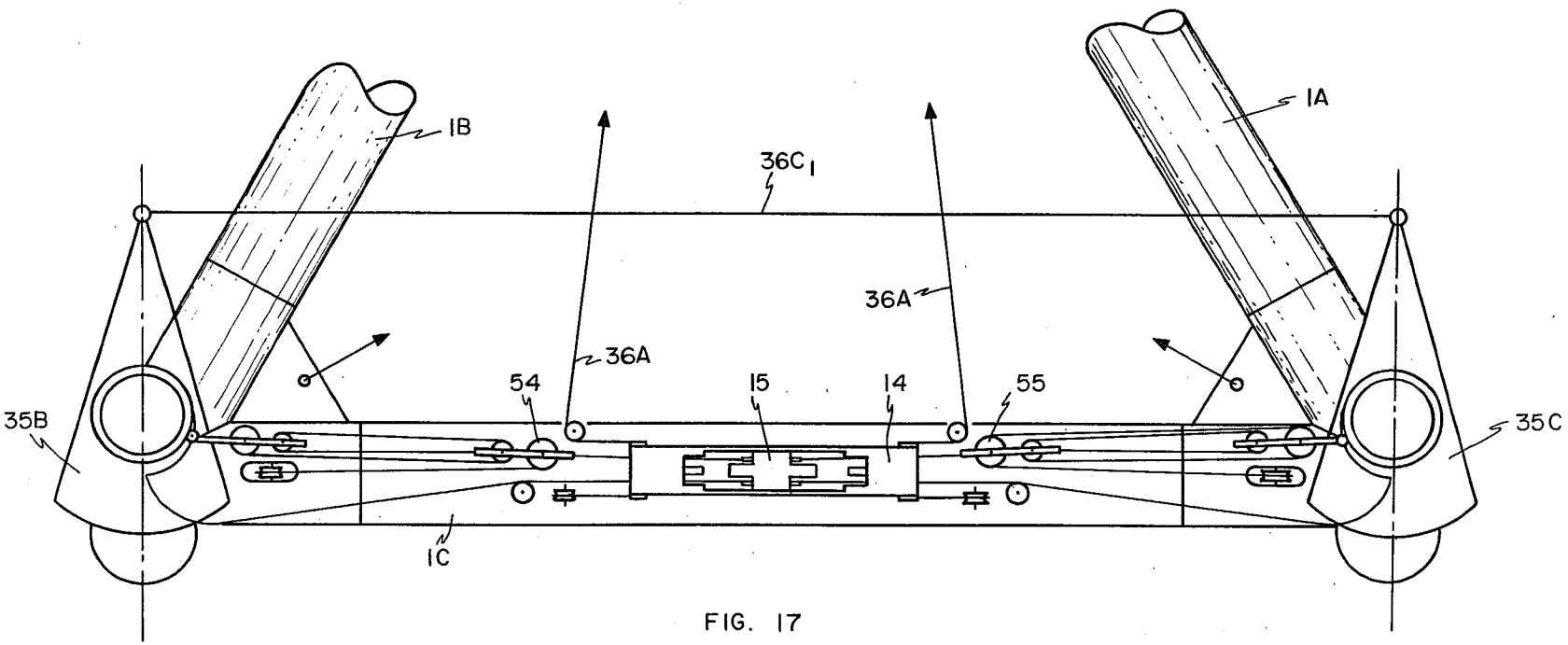
Figure 18:
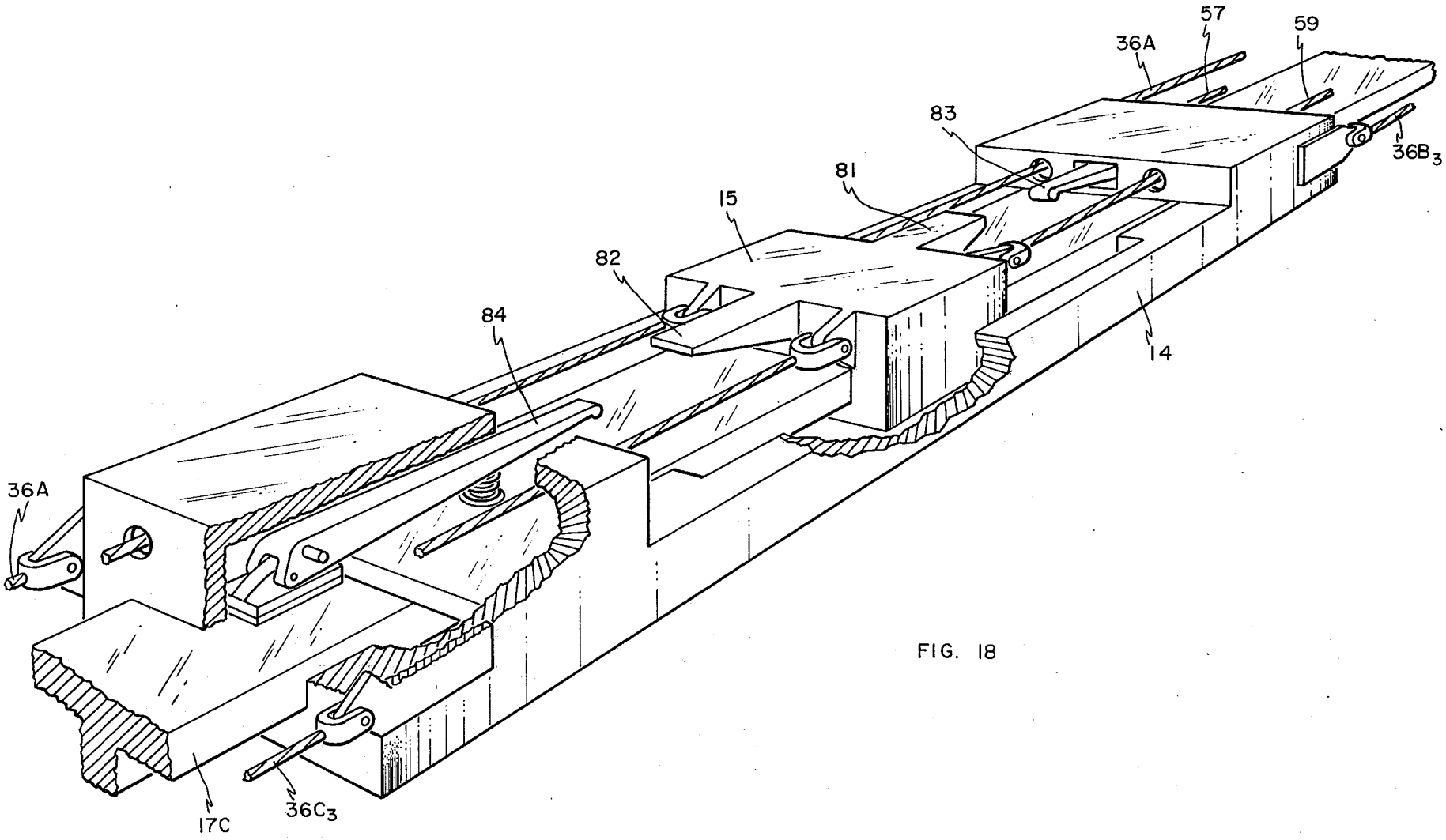
Figures 19A, 19B, 19C, 19D, 19E:
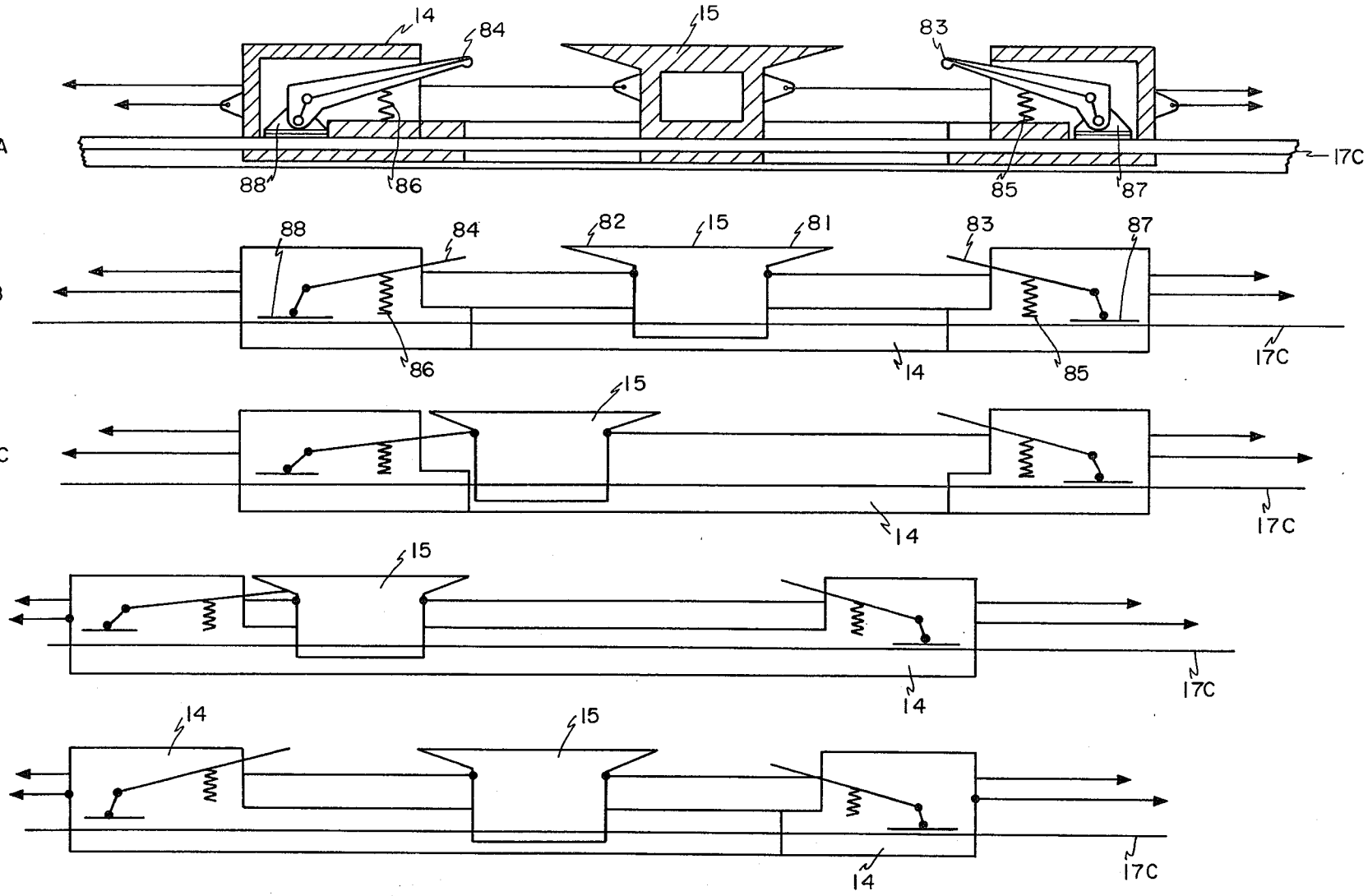
Figure 20:
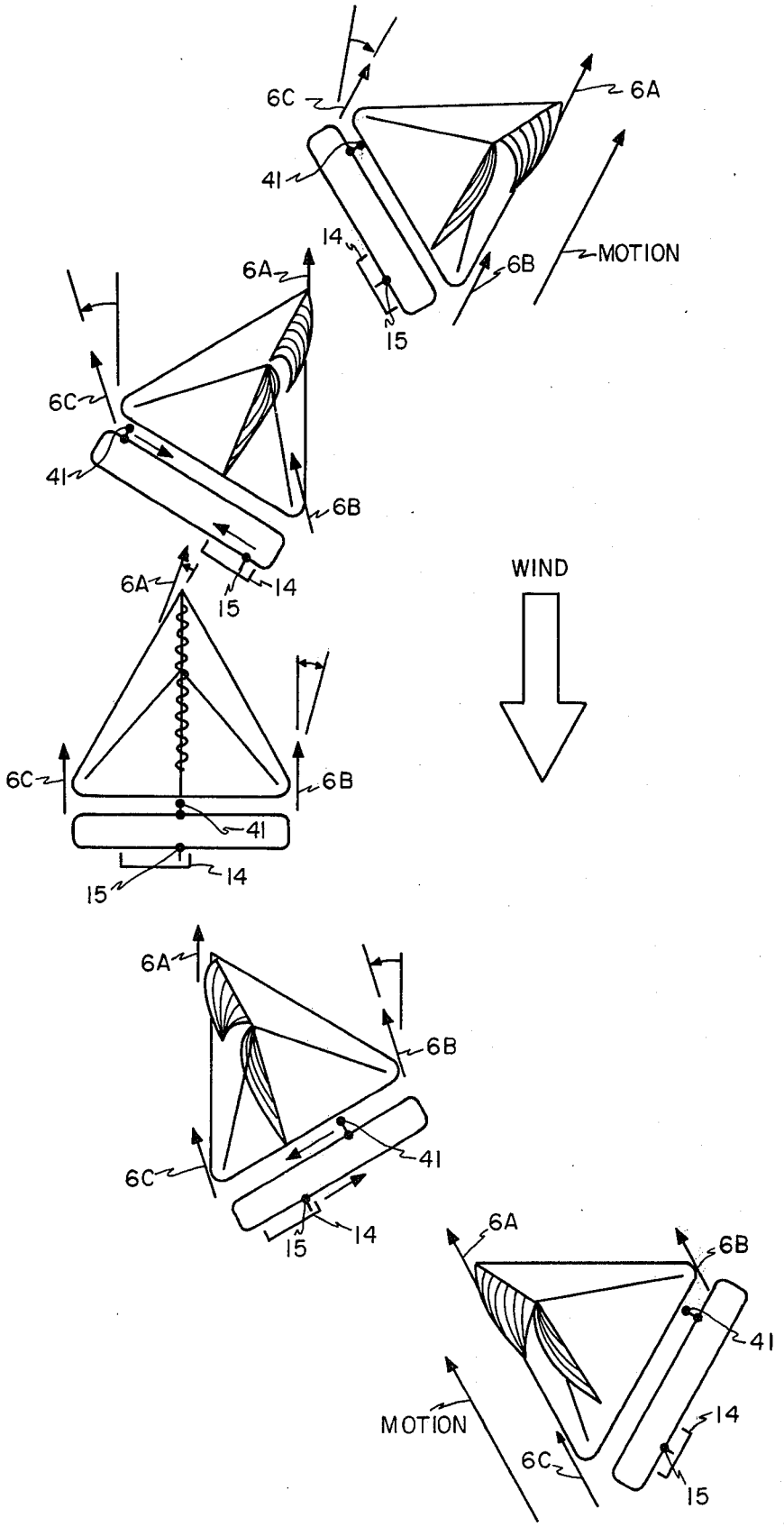

FIGS. 10A, 10B, and 10C are isometric views that together show a typical hull connection to the vertex structure of the sailboat of FIG. 1;

FIGS. 11A, 11B, 11C are diagrammatic representations of the angular orientation of the three hulls of the sailboat of FIG. 1 under various wind conditions;

FIGS. 12A, 12B, 12C and 12D are diagrammatic representations of the structural details of the bow vertex, illustrating the connection technique envisioned for the deck beams, of the sailboat of FIG. 1;

FIGS. 13A, 13B, 13C, 13D and 13E show the structural details of the port stern vertex of the sailboat of FIG. 1 (the starboard stern vertex has the same form but is a mirror image of the port stern vertex);

FIGS. 14A and 14B show structural details of the mast foot connector of the sailboat of FIG. 1, to which the lower mast stays are affixed;

FIGS. 15A and 15B show structural details of the mast head connector of the sailboat of FIG. 1;

FIGS. 16A and 16B are respectively schematic view of the tiller cable configuration and a view of the travel range of the stern and bow tiller blocks of the sailboat of FIG. 1, looking upward from below the respective elements;

FIG. 17 is an actual view of the bottom of the stern deck beam showing the tiller mechanism configuration, of the sailboat of FIG. 1;

FIG. 18 is an isometric view, partly cutaway, of the stern and bow tiller block mechanisms of the sailboat of FIG. 1;

FIGS. 19A, 19B, 19C, 19D, 19E are a set of diagrammatic representations showing the operation of the tiller block locking mechanism of FIG. 18, FIG. 19A being a cutaway; and FIG. 20 is a diagrammatic representation illustrating the coordination of the bow and stern hulls in the execution of a tacking maneuver, for the sailboat of FIG. 1, looking down upon the sailboat, the interconnection mechanism being idealized for conceptual purposes.

Before going into detailed explanation of the invention with reference to the figures, some comments of a more general nature are made in the next few paragraphs. It should be noted that the terms horizontal and vertical are used loosely here for ease of explanation; a more rigorous description is presented in the following technical details.

The three-pontoon or three-hull sailboat of the present invention solves the tacking problem of the proa, yet does not incur the displacement problem of the catamaran, nor the leeward outrigger drag of the trimaran. The capabilities of the present sailboat are dependent on the unique tetrahedral-type design embodied in its space frame. The space frame is composed of a triangular deck beam structure and a mast. The mast is fixed to the deck beam structure by means of three top stays (cables) which extend from the three respective vertices of the deck beams to the head of the mast and three bottom stays which extend from the three respective vertices of the deck beams to the foot of the mast. Thus, the whole space frame structure is one unit which is made rigid by virtue of the configuration utilized. Turnbuckles on the bottom stays are used to tighten the stays and load the deck beams. The vertices use socket type fittings to accept the deck beams. This construction technique allows the space frame structure to be completely disassembled or assembled just by loosening or tightening one turnbuckle.

The present sailboat utilizes three hulls, one disposed at each of the vertices. The hulls can be rotated in the horizontal plane about a vertical axis through each vertex. Each hull is free to rotate in the vertical plane about a horizontal axis. All these rotations are constrained to occur only in definite angular ranges. Each hull is identical to the other and is designed to operate in the planing mode under normal sailing conditions. The present design can utilize any single-masted type of sail plan including a sloop-type sail plan or an Una Rig sail plan. (A Una Rig is a single mainsail; no jib is used, and the mast rotates with the sail.) Only the sloop sail plan is illustrated herein. is illustrated herein.

The bow of the present sailboat is at the forward apex of the triangular deck. The bow hull at this apex is used to change the orientation of the deck triangle relative to the sailing direction, that is, the whole bow hull is rotated in the horizontal plane relative to the deck triangle. Rotation of the bow hull is controlled by a bow-hull tiller slider block mounted on a rail along the stern deck beam, which is the base of the triangular deck. The two stern hulls are linked to rotate in unison; they are controlled by a stern-hull slider block mounted on a second rail along the stern deck beam. The two stern hulls are used to steer the sailboat. When running before the wind, the long axis of the bow hull is kept parallel to the altitude of the triangular deck configuration. The stern hulls are maintained in parallel positions relative to the bow hull. On a starboard tack, the bow hull and the port stern hull are maintained parallel to the port deck beam, and the starboard stern hull acts as the outrigger. This configuration is reversed for a port tack, and the port stern hull acts as the outrigger. The stern-tiller block as later shown, is nested within the bow-hull tiller block. A bow-hull tiller block is free to move only when a stern-hull tiller block impinges on the limits of its travel within the bow-hull tiller block constraints. The motion which the stern-hull tiller block can have before the bow-hull tiller block must be moved, is equivalent to +20 degrees on either side of the equilibrium (all hulls parallel) condition.

In coming about between tacks, when both the bow hull and the two stern hulls are being rotated, the bow hull lags the stern hulls by twenty degrees. In order that the bow hull be oriented correctly for a starboard or port tack, the stern hull must overshoot the nominal angular orientation by twenty degrees. In actuality, the bow-hull tiller block mechanism can be locked in any intermediate angular position to obtain the optimum sailing configuration.

As previously mentioned, each hull is allowed to rotate freely in the vertical plane about a horizontal axis through a fixed angular range. This degree of freedom allows the hulls to move over waves and general turbulence, instead of plowing through the waves and turbulence. Each hull is connected to the deck vertices by a tubelike structure. This structure has hinge pins at its lower end about which the hull rotates in the vertical plane. This tubelike structure is rotated at the vertex by means of the tiller blocks, through the use of cables. Each tubelike structure houses a dagger board. The lower edge of each dagger board can be retracted so that it does not protrude below the bottom of the hull. The insertion of the dagger boards at each vertex can be used to control the trim of the sailboat. The stern dagger boards can be connected to the mechanisms which control the stern hull orientations, such that the windward stern hull always has a retracted dagger board, while the leeward stern hull (which is aligned with the bow hull) always has an inserted dagger board. The stern hull dagger board insertion is a function of angular hull orientation in the horizontal plane. The retraction of the dagger board in the potentially flying hull (the acting outrigger) reduces the drag on this hull and allows the present sailboard to sail faster. It should be remembered that the bow and the remaining stern hull still can have their dagger boards fully inserted for control of the sailboat.

The helmsman, when sailing the three-hulled boat of the present invention, is considered as having a dual function: sailing the boat and serving as live ballast. This dual function is built into the design of the boat. If he sails the boat correctly, he always sits near the windward stern hull; in order to do this efficiently, the tiller must be near the windward stern hull also. To facilitate the motion of the helmsman from the port to the starboard stern hull, or vice versa, a helmsman seat is mounted on a third rail mounted on the stern deck beam. He uses his feet to propel himself in his seat along this rail when coming about between tacks. The bow and stern tiller blocks also slide on a rail on the stern deck beam as previously discussed. Thus, when the helsman shifts position along the stern deck beam, he takes his tiller control with him.

The present sailboat has a weight advantage over the proa, the catamaran, and the trimaran. The three hulls are disposed to give the maximum stability possible for a given displacement. The sail area to weight ratio can probably be made double that of the aforementioned sailboat types, because of the optimum distribution of buoyancy in the present design. The present sailboat is structurally superior to earlier designs because the space frame contacts the sea at three points; no matter what the sea conditions are, the weight of the boat is always supported by these three points (unless the helmsman elects to fly a hull). In the proa, the catamaran, or the trimaran, see conditions can put tremendous loads on the structural members, because three point support is not built into the basic design.

Furthermore, the tetrahedral space frame design herein disclosed assures that structural member loadings are almost independent of sea conditions. The hulls of this boat can pivot to ride over rather than plow through waves. This feature eliminates the possibility of pitch poling (a serious problem is catamarans). This capability also makes the present design more sea kindly and a more stable sailing platform than other types of sailboats.

The hulls of the present structure can be rotated in the horizontal plane to suit any sea and wind conditions; thus, by varying these orientations, one effectively has a different sailboat. The dagger board insertion can be adjusted to suit wind and sea conditions. The boat has been designed to turn rapidly when coming about. This has been accomplished by changing the configuration of the "hull," that is, the stern hulls are rotated relative to the bow hull; there is no rudder per se. The sailing capabilities of the present design can be improved further by the raking or tilting the axis of the three vertices back toward the stern of the sailboat. This modification increases the resistance to leeward drifting and aids the planing capabilities of the hulls even when "flying a hull." This will be explained in greater detail later.

Turning now to FIG. 1, there is shown at 101 a sailboat with a helmsman 102 seated near the port stern vertex of a rigid, triangular deck frame 1. (Many structural elements of the sailboat 101 that are shown in later figures are not, for simplicity, shown in FIG. 1.) The sailboat 101 is sailing on a broad (port) reach; the water is labeled 104 in FIG. 1, merely to place the explanation in context. It is later shown that the boat 101 can be sailed by one person, although it can accommodate more. In the following description, a one person crew is assumed, he is the helmsman and he can move across the stern portion of the frame 1 in tacking maneuvers as described shortly. First, however, some aspects of the structure are given.

The frame 1 consists of three beams 1A, 1B and 1C (e.g., aluminum tubes, ⅛ inch wall, five inch O.D.) that form the sides of a triangle whose vertices are at 2A, 2B and 2C. Later, it is shown that the structural elements at 2A, 2B and 2C are fittings or connectors, but, for now, it suffices that the designations be used to denote the vertices of the triangular frame 1. A mast 3, extending outward from one side of the plane of the triangular deck beam structure 1, is secured respectively at the head 3A and the foot 3B thereof to the vertices or vertex components 2A, 2B and 2C of the triangle respectively by cables 4A, 4B and 4C and 5A, 5B and 5C in FIG. 1; the cables 4A, 4B and 4C are secured to the head of the mast 3 through a fitting 11 and the cables 5A, 5B and 5C are secured to the foot of the mast 3 through a fitting 12. The mast 3 is disposed substantially orthogonal to the plane of the triangle, and the foot 3B of the mast pierces the plane of the triangle. Extending downward from the triangular frame 1 are three hulls 6A, 6B and 6C positioned respectively at the three vertices 2A, 2B and 2C of the triangle and having two degrees of freedom, that is, freedom in the horizontal plane and in the vertical plane, as later discussed. The sailboat 101 has a main sail (or main) 7 and a jib 8. The boom 9 of the main sail is of a length such that it can pivot within the confines of the triangular deck frame without striking the cables 4B and 4C. A webbing 10 serves as a deck.

Figure 2A:
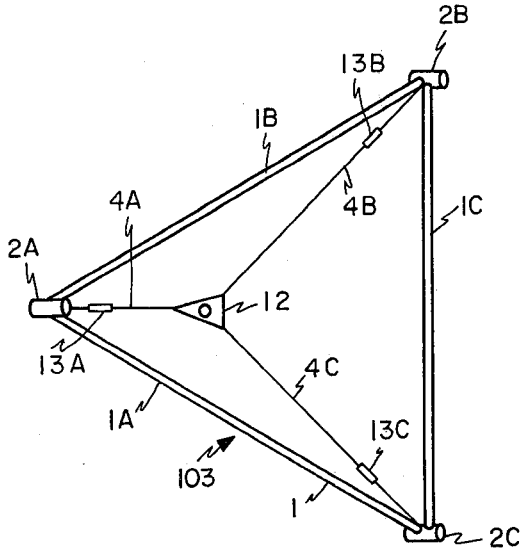
Figure 2C:
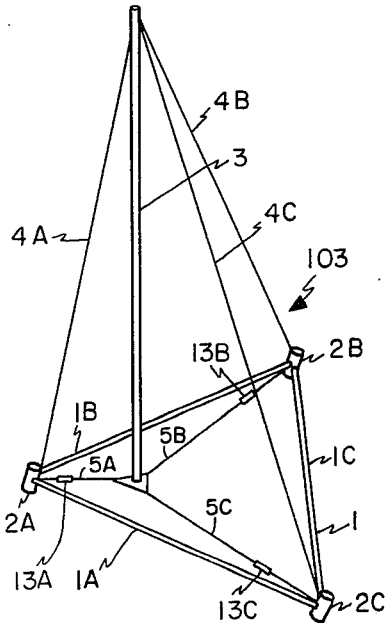
Figure 2B:
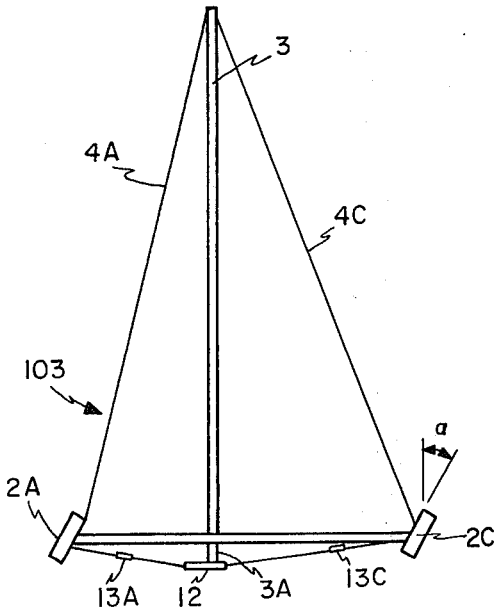

Previous mention is made to what is termed a tetrahedral-type space frame; a preferred form of space frame is shown at 103 in FIGS. 2A–2C composed of the triangular deck beam structure 1, the mast 3 (e.g., an aluminum tube with elliptical cross section, ⅛-inch wall, five inch maximum diameter) stays 4A . . . and 5A . . . , and so forth. It can be seen in FIG. 2B that the lower foot 3B of the mast pierces the plane of the triangular structure 1. The stays 5A, 5B and 5C are adjusted in tension by turnbuckles 13A, 13B and 13C, respectively; the tension, thus applied, renders the space frame mechanically rigid and capable of withstanding forces originating with the sails as well as forces emanating from the hulls, which forces tend to distort the space frame 103 and hence must be withstood for the frame to be mechanically stable.

The unique space frame design 103 lends itself to additional capabilities heretofore impossible to embody in a sailboat. When a person on waterskis makes a turn, he tilts his feet so that the skis dig into the water preventing sideslipping. A sailboat encounters the same problem when it is on a reach or when it is tacking; the wind force on the boat pushes the boat to the leeward thereby leading to less efficient use of the wind force in achieving forward motion of the boat. In a conventional sailboat, the center board or dagger board is used to offset this leeward drift. In the present design, as later shown, the vertex components 2A, 2B, and 2C are designed so that their axes of rotation are raked backward toward the stern, an angle $\alpha$ (as shown in FIG. 2B); this can be easily accomplished, as explained shortly. The ramification of this tilting is that the hinge pin axis of each hull remains horizontal only when the present design sailboat is running before the wind. When the sailboat is on a port tack, the axis of each hinge pin, of the hulls 6A,6B,6C tilts upward on the starboard side; thus the hulls mimic the tilt of waterskis when the waterskier is making a turn toward the left. Similarly, this rake angle forces the hulls 6A–6C to tip upward on the port side when the sailboat 101 is on a starboard tack or a beam reach with the wind coming from the starboard side. This tilting decreases leeway made by the boat since the hulls 6A–6C dig into the water, just like the waterskis. Under stronger wind conditions the helmsman 102 might elect to fly the windward hull; as the windward hull lifts out of the water, the angle that the hull hinge pins make with the horizontal plane decreases (see FIGS. 11B and 11C). FIG. 11A illustrates the hull configurations when sailing before the wind. FIG. 11B illustrates port tack hull orientation and the FIG. 11B illustrates starboard tack hull orientation. It will be noted that in both cases, when the windward hull is not being flown, the hulls dig in to prevent leeward drifting. When the windward hull is being flown, the hulls again become parallel to the water surface, which is the ideal planing configuration. This configuration makes the two leeward hulls more likely to plane when the windward hull is flown. The helmsman's judgement must be used to determine how much to rotate the hulls relative to the deck triangle since this rotation determines exactly how much the hulls can tilt, which affects the leeward resistance and the planing capability with the windward hull flying. Under certain sailing conditions, this tilting hull capability can reduce or eliminate the need for insertion of the dagger boards hereinafter discussed, thus lowering the drag on the sailboat 101. The tilting of the vertex components 2A–2C relative to the horizontal plane can be accomplished by a number of means; two of the most evident are now discussed.

Figure 7:
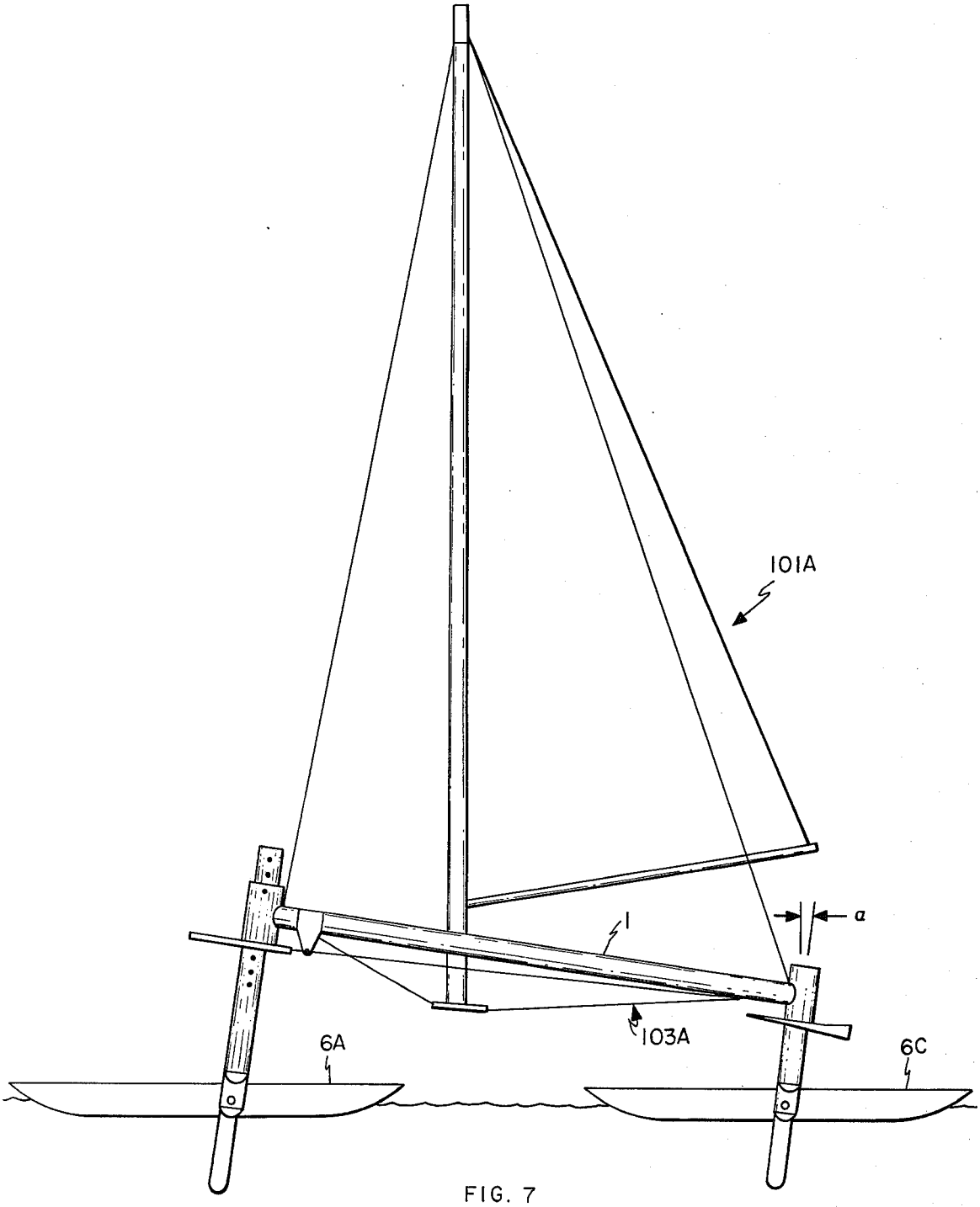
FIG. 7 is a side view of an alternate space frame design for the sail boat in FIG. 1.
Figure 8:
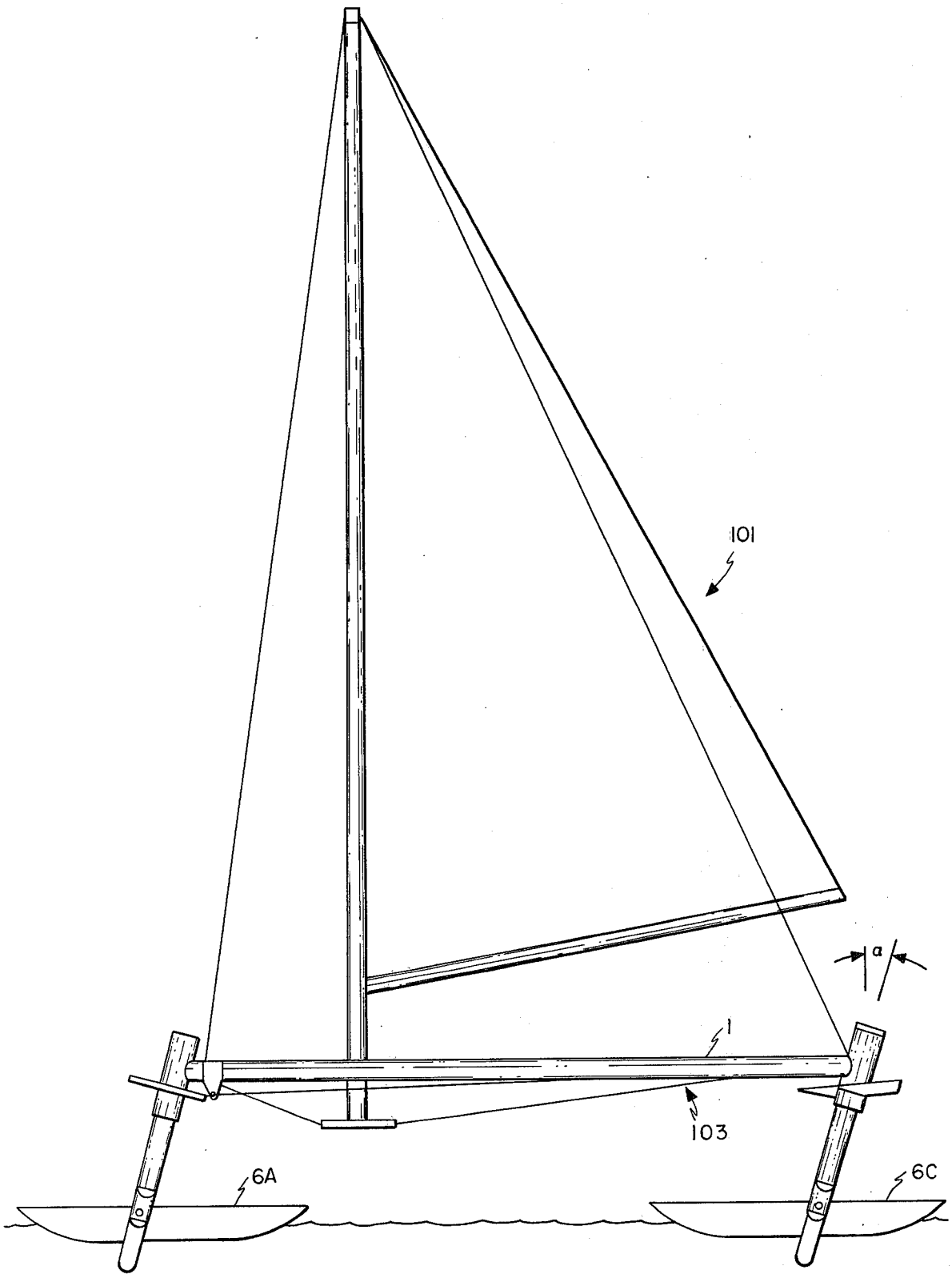
FIG. 8 is a side view of the space frame as used in the sailboat of FIG. 1.

The simplest solution is to build the space frame 103 with the components 2A–2C tilted relative to the plane of the deck triangle, as illustrated in FIG. 8. The other solution is to raise the bow vertex along the bow dagger board housing as shown in the embodiment of FIG. 7 wherein the space frame is marked 103A and the sailboat 101A. The modification incorporated in the space frame 103A serves to increase the distance between the bow hull shown at 6A and the deck triangle (again marked 1 in FIG. 7) relative to the distance between the stern hulls (only the hulls 6A and 6C are shown in FIG. 7) and the deck triangle. The deck triangle is now tilted upward toward the bow, and is therefore not parallel to the horizontal plane as is true in the sailboat 101 in FIGS. 2A–2C and FIG. 8. The tilt of the deck triangle can be fixed thereby fixing the maximum tilt of the hulls to counteract leeway; or the tilt angle of the deck can be made adjustable within some practical range. This latter option makes the present sailboat extremely versatile in adapting to wind and sea condition at the helmsman's discretion. The tilt angle of the deck is set merely by fixing the bow dagger board housing within the bow vertex at various positions along the housing.

Figure 9:
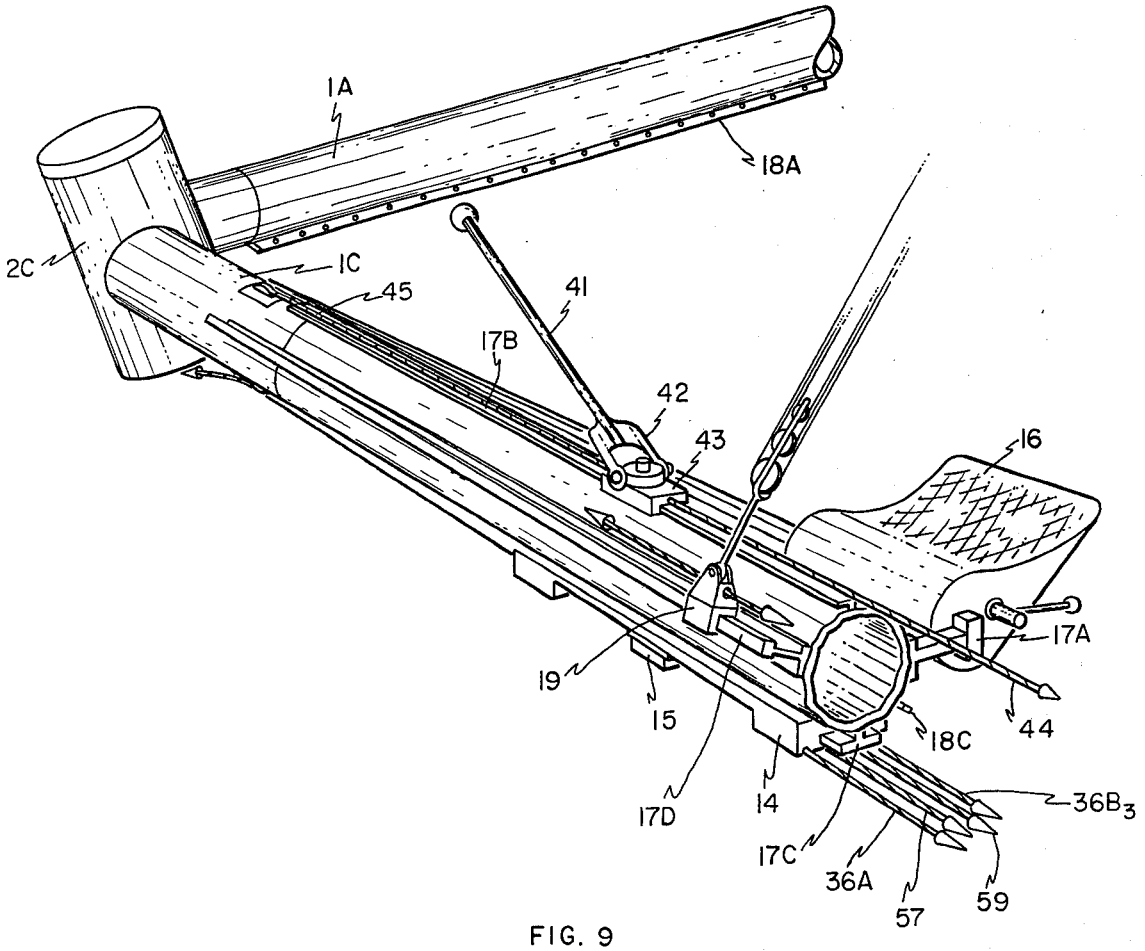
FIG. 9 is a detailed isometric view of the stern deck beam of the sailboat of FIG. 1.

A detailed discussion of the fifteen components that form the space frame 103 now follows. The stern deck beam 1C in FIG. 9 is a tubular beam having "T" rails 17A, 17B, 17C and 17D affixed to it. The "T" rail 17A serves a runner for the helmsman's chair labeled 16 in FIG. 9. Bow and stern tiller blocks 14 and 15, respectively, ride on the underside of the "T" beam 17C. A main sheet slider 19 rides on the "T" beam 17D. A main tiller block 43 rides on the "T" beam 17B. A lacing strip 18C is affixed to the stern deck beam. The beam 1C is a separate component which fits into sockets in the respective port and starboard vertex components 2C and 2B (not shown in FIG. 9). The beam 1C is held in place by the tension in the mast stays, a locking pin is inserted in each socket for added safety; see the lock pin 80 for the component 2A in FIG. 12A. (The fitting and socket arrangement used to permit a secure joint between the beam 1C and the component 2C is used throughout to permit easy disassembly of the boat 101.)

The port deck beam 1A, as shown in FIG. 9, is a tubular beam having a single lacing strip 18A affixed to it to provide an attachment to the deck trampoline 10. The beam 1A is a separate component which fits into sockets in the bow and port vertex components 2C and 2A (not shown in FIG. 9), respectively. The beam 1A is held in place by the tension in the mast stays 5A–5C.

The starboard deck bean 1B is the same as the port deck beam 1A, except that the beam 1B is fixed into sockets in the bow and starboard vertex components, respectively.

Figure 12A:
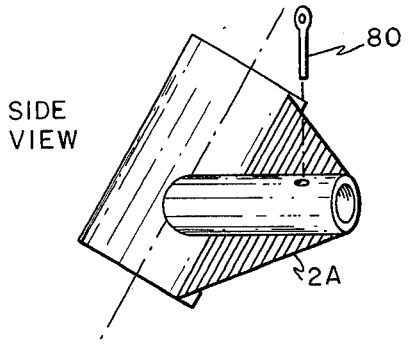
Figure 12B:
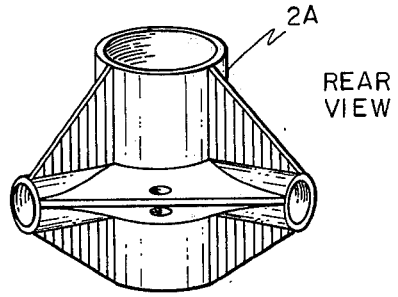
Figure 12C:
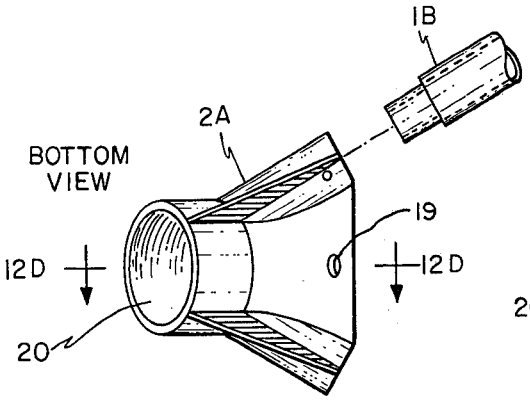
Figure 12D:
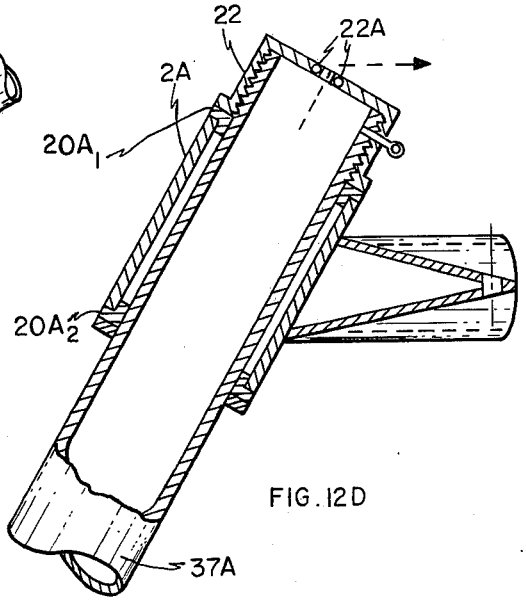

The bow vertex component 2A, as shown in detail in FIGS. 12A–12D, is the connector for the port and starboard deck beams 1A and 1B, respectively (see FIG. 1). It also has an eyelet 19 in FIG. 12C to which the upper and lower bow mast stays are attached. Furthermore, it embodies a journal 20 in which the bow hull shaft labeled 37A in FIG. 3A can rotate. A suitable thrust and radial bearings $20A_1$ and $20A_2$ in FIG. 12D are incorporated in the vertex structure to hold the bow hull shaft. The bow hull vertex component 2A also incorporates, in the alternate space frame design of FIG. 7, a mechanism to adjust the distance between the bow hull vertex component 2A and the bow hull hinge pin labeled 32A in FIG. 3A. The angle the vertex component 2A makes with the deck plane determines the angles the short axis (axis of typical hinge pin 32C, FIG. 4) when the bow hull shaft is rotated. The vertex components 2A–2C all make the same angle $\alpha$ with the plane of the deck 10.

The port vertex connector 2B (see FIGS. 13A–13C) receives the port and stern deck beams 1B and 1C, respectively. It also has an eyelet 21 in FIG. 13C to which the upper and lower port mast stays are attached. Furthermore, it embodies a journal 22 in which the port stern hull shaft, later discussed, can rotate. Suitable thrust and radial bearings are incorporated in the vertex structure to hold the port stern hull shaft, similar to the bow vertex bearings. These bearings may typically be made of some plastic liner material such as nylon or hyperlon which require no external source of lubrication.

The starboard vertex component 2C is similar to the port vertex except that it is located at the junction of the starboard and stern deck beams.

The mast 3 serves two functions: it is used to support the sail and also to make the space frame structure 103 rigid. It is composed of a tubular beam having the normal appendages for the sail plan and rigging desired. In the illustrations herein, a sloop rig is shown. The mast 3 can be fixed or free to rotate as the boom 9 in FIG. 1, swings around during tacking maneuvers. The mast is held in place by a socket 12A in FIGS. 14A and 14B at the foot 3B and a socket 11A in the fitting 11 at the head 3A in FIGS. 15A and 15B; these sockets are in turn held in place by the mast stays.

The mast foot socket 12A that receives the foot 3B of the mast 3 is in the triangular-shaped plate 12 having eyelets 23A–23C in FIG. 14B at the three vertices to receive the three lower mast stays 5A–5C in FIG. 1.

The mast head socket 11A receives the head 3A of the mast 3. The fitting 11, as shown in FIGS. 15A and 15B, has three ears 25A–25C with eyelets 24A–24C, respectively, to receive the respective upper mast stays 4A–4C. The upper mast stays 4A–4C in FIG. 1 connect each of the deck vertex components with the mast head socket element 11. These stays are made of cables capable of sustaining normal space frame loadings, in addition to the preload required to make the space frame rigid.

The lower mast stays 5A–5C in FIG. 1 connect each of the deck vertex components to the mast foot fitting 12. These stays are made of cables capable of sustaining normal space frame loadings in addition to the preload required to make the space frame 103 rigid. In addition, each of the lower mast stays incorporates a tensioning device such as the turnbuckles in 13A,13B and 13C, FIGS. 2A–2C, to preload the space frame, as well as to adjust the mast to the desired angle relative to the plane of the deck triangle.

Figures 3A, 3B:
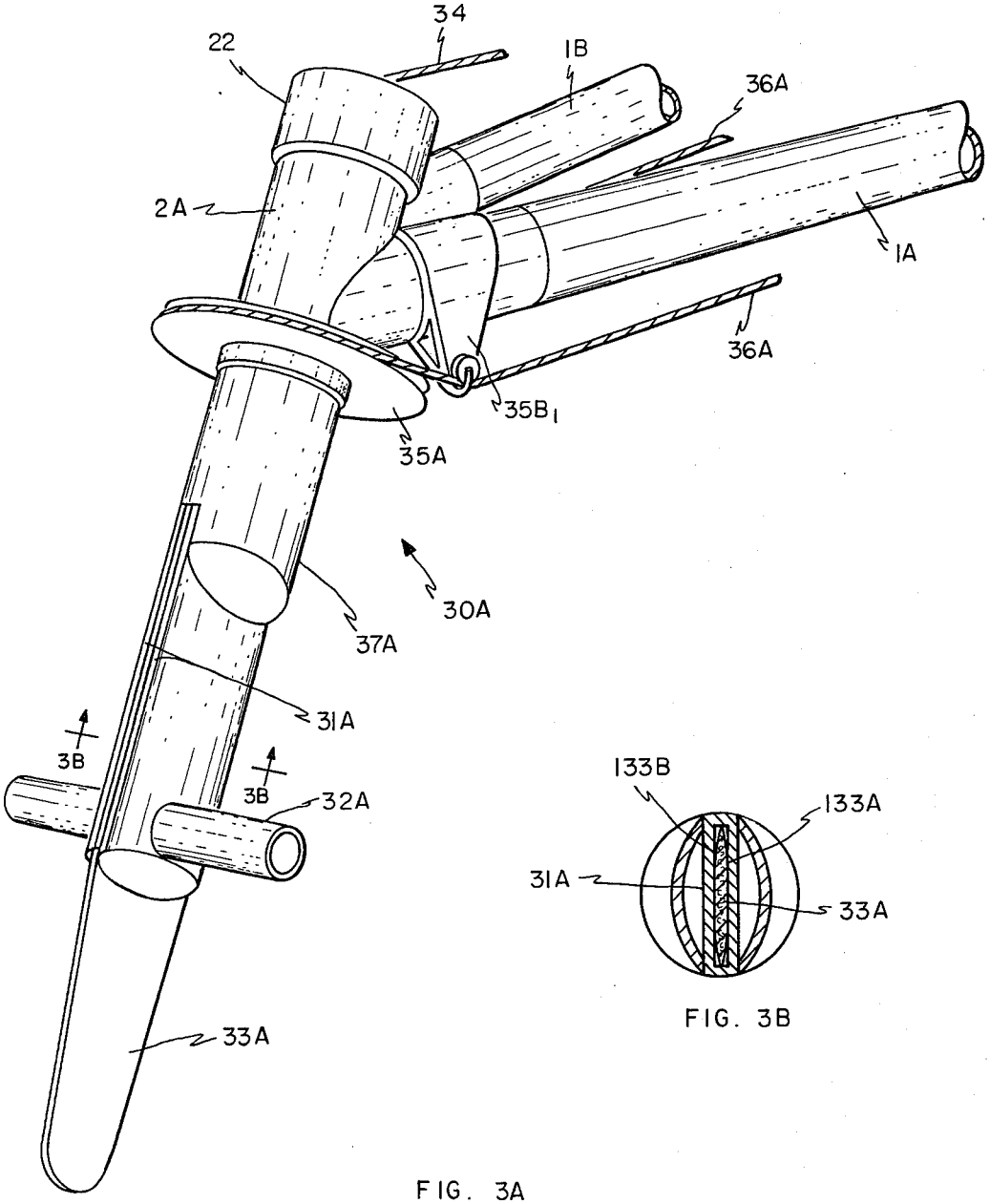
FIGS. 3A and 3B are respectively a detailed isometric view showing the bow vertex elements of the sailboat of FIG. 1 and a section view taken on the line 3B—3B in FIG. 3A.

The bow shaft assembly shown at 30A in FIGS. 3A and 3B consists of four basic components. The first component is the bow hull shaft proper 37A; it is tube-like structure which fits into the bow vertex component 2A, and is capable of rotating therein. (In the alternate space frame design of FIG. 7, the shaft 37A can be shifted up into or down out of the bow vertex component 2A by a special mechanism.) The second component is a bow hull hinge pin 32A. The third component is guide 31A for the bow dagger board. The fourth component is the bow hull dagger board shown at 33A. A bow hull shaft 31A in FIGS. 3A and 3B has suitable guides 133A and 133B on the sliding surfaces thereof to allow easy insertion and withdrawal of the dagger board 33A using a dagger board elevation cable 34.

A bow hull control pulley 35A in FIG. 3A is fixed onto the bow hull shaft proper 37A, and is used both to rotate the bow hull 6A in FIG. 1, as well as to hold it steady under sailing condition. The bow hull 6A is used to change the configuration of the sailboat to suit sailing conditions. A bow hull control cable 36A is pinned into the pulley 35A, and wraps around a pulleys 35B$_1$ and another, and similar, pulley (not shown) before going to tiller block mechanisms in FIGS. 16A, 17, 18 and 19A–19E; see the discussion later herein.

A bow shaft cap 22 in FIGS. 3A and 12D locks the bow shaft 37A into the bow vertex component 2A. The cap 22 is removable for disassembly of the bow shaft from the bow vertex component 2A. The thrust bearings 20A$_1$ and 20A$_2$ in FIG. 12D prevent rubbing between the shaft 37A and the bow vertex component 2A; A small pulley set 22A, FIG. 12D, is incorporated in the cap 22 to allow the cable 34 (which controls the bow hull dagger board insertion) to pass throught the cap without abrasion.

The bow hull dagger board 33A in FIGS. 3A and 3B slides up into the bow hull shaft 31A. The dagger board guides 133A and 133B in the bow hull shaft 31A (see FIG. 3B) cause the dagger board 33A to rotate with the shaft 31A and the bow hull 6A. The guides 133A and 133B have low friction liners to allow easy motion to the dagger board 33A. The dagger board 33A should have an airfoil cross section for optimum sailing efficiency. When fully retracted the dagger board does not protrude beyond the bottom of the bow shaft 37A, nor impinge on the bow shaft cap 22.

Figure 4:
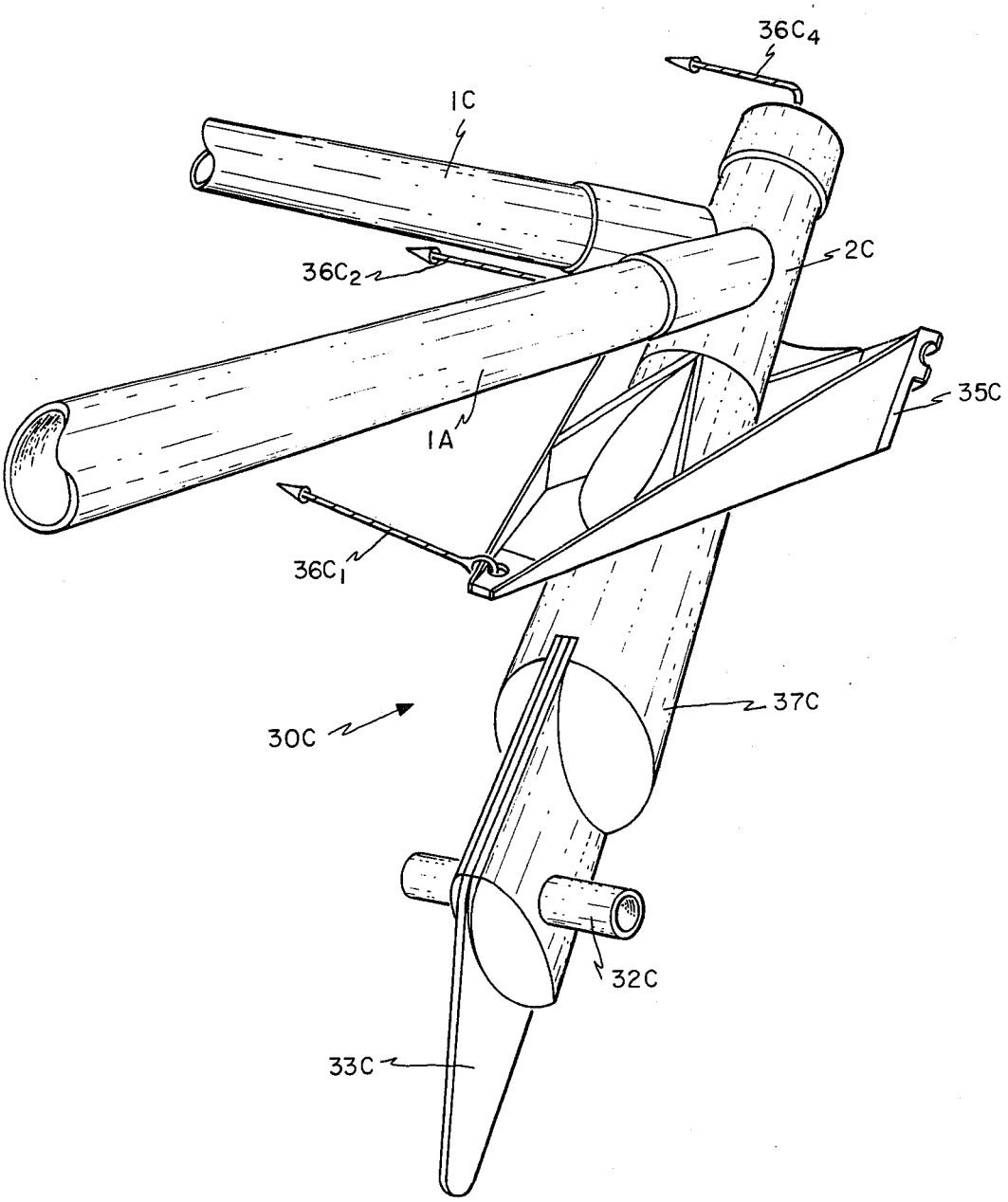
FIG. 4 is a detailed isometric view of port stern vertex elements of the sailboat of FIG. 1.

The port shaft assembly shown at 30C in FIG. 4 consists of four basic components. These components are similar to the bow hull shaft components except for the port hull control pulley labeled 35C which has counter tension control cables 36C$_1$ and 36C$_2$ that assure that the port and starboard hulls 6C and 6B, respectively, in FIG. 1, remain parallel during all maneuvers. The port and starboard stern hulls are used in tandem to steer the sailboat. In addition, the dagger board elevation cable 36C$_3$ in FIG. 16 comes out of the port shaft below the port vertex (not shown, but similar to 36B$_3$ in FIG. 5). One other difference in the port and starboard shaft assemblies relative to the bow shaft assembly is that the control cable 56 and 58 wrap around 100 degrees of pulley circumference, instead of approximately 160 degrees. The cable is pinned into the pulley. There is also a cable 36C$_4$ which is used to elevate the port dagger board independent of the tiller position.

Figure 5:
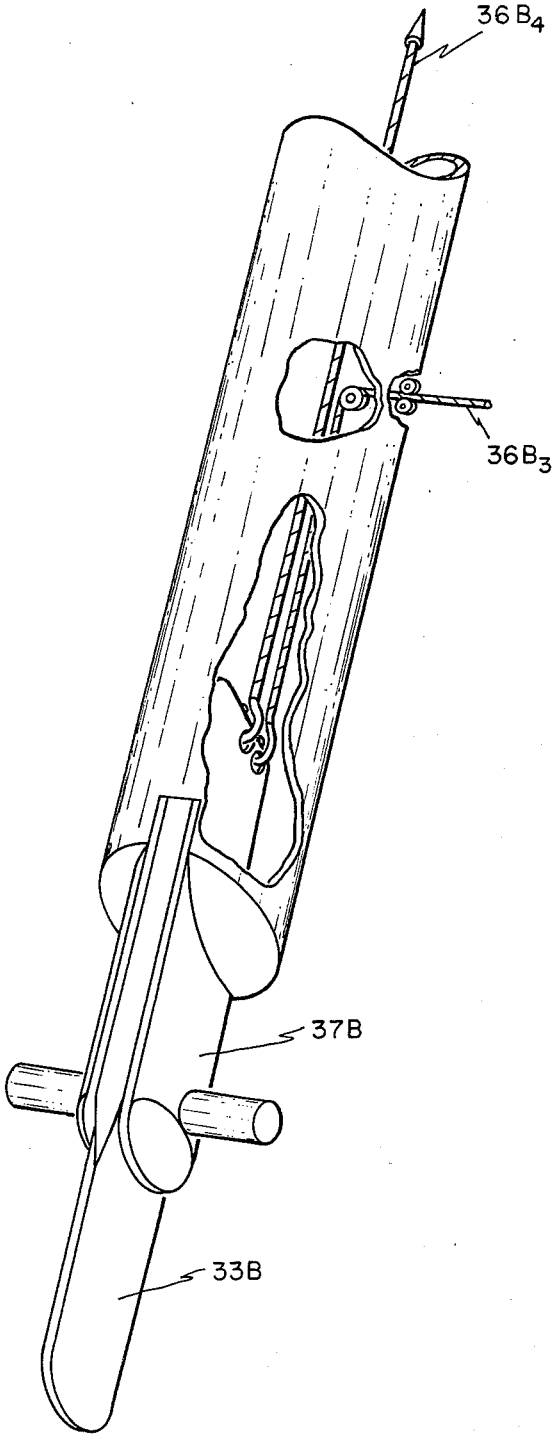
FIG. 5 is a detailed isometric view of a dagger board elevation mechanism in stern starboard vertex of the sailboat of FIG. 1.

The starboard shaft assembly, not shown in detail in the drawing, is identical to the port shaft assembly 30C except that the dagger board elevation control cable comes out of the opposite side of the shaft; see FIG. 5.

Figure 6:
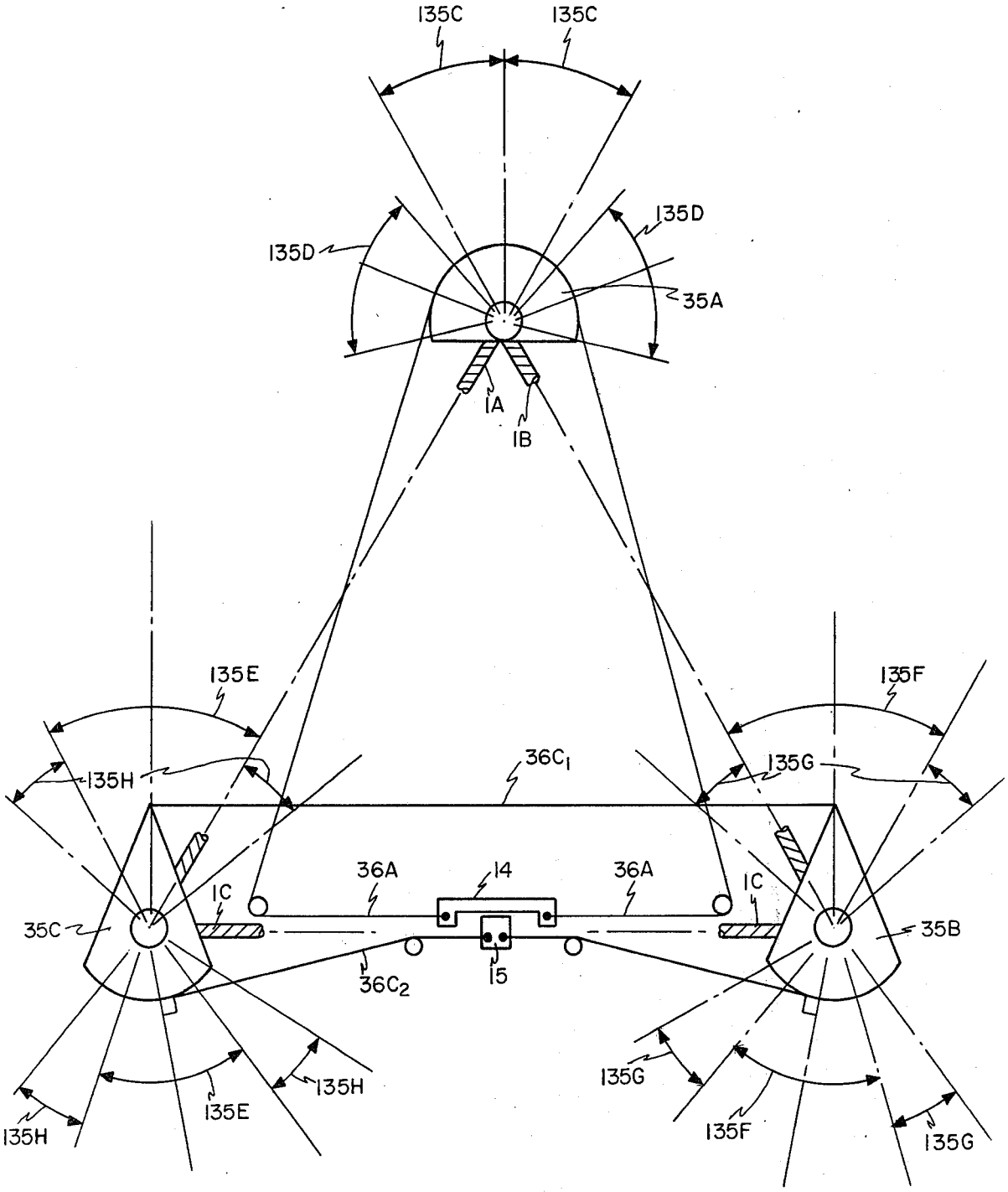
FIG. 6 is a plan view showing hull orientations of the sailboat of FIG. 1 and an idealization of the interconnection between stern and bow hull tiller blocks.

FIG. 6 illustrates an idealized control cable configuration for bow and stern hull rotation. The pulley 35A can rotate through a maximum angular range of $\pm 30°$ about its nominal position, as shown; the nominal position is used for sailing downwind. This range is shown as 135C in FIG. 6. The control cable 36A wraps around pulley 35A, as shown. The normal steering range for the stern hulls is shown as 135E and 135F in FIG. 6 and is also $\pm 30°$ about the nominal position. The overshoot of $\pm 20°$ on either side of the normal range is shown as 135H and 135G in FIG. 6.

The sailboat 103 is steered by a tiller in FIG. 9, having a tiller rod 41 that is connected by a swivel coupling 42 to a main tiller block 43. The main tiller block 43 slides along the "T" rail 17B, which is fixed to the stern deck beam 1C, in response to a pull or push on the tiller rod 41. The main tiller block 43 can be fixed along the rail 17B at any point by engaging a locking device in the block. The main tiller block 43 is connected to two control cables 44 and 45, one of which (the cable 45) goes to the port vertex component 2C, and the other of which (the cable 44) goes to the starboard vertex component 2B. Each cable wraps around a sheave shown schematically, at 50 and 51 in FIG. 16A; it then passes through the respective vertex sockets (FIG. 13D) wraps around another sheave 52 and 53; and from there goes to the respective block and tackle mechanism 54 and 55. These in turn are fastened to the stern hull tiller block 15 by additional cables 56 and 57, respectively. Two other cables 58 and 59 go from the block 15 to two sheaves 60 and 61 and thence to the stern hulls control pulleys 35B, 35C. When the tiller rod 41 in FIG. 16A is pulled along the stern deck beam rail 17B, in FIG. 9, the block and tackle mechanism 54 and 55, FIG. 16A, multiply the tension in the tiller rod 41 and rotate the stern hulls 6A and 6B in FIG. 1 via their respective control pulleys. The mechanical advantage of the block and tackle mechanisms 54 and 55 is set so that the total travel of the main tiller block 43 along the stern deck beam 1C is equivalent to a rotation of the stern hulls through 100 degrees, from one extreme position to the other. The 100 degree rotation consists of 60 degrees used for normal steady state sailing plus 20 degrees at either end of its travel for overshoot, to lock the respective bow hull in its correct orientation; see later discussion. Motion of the main tiller block 43 and resulting motion of the bow hull tiller block 14 and the stern hull tiller block 15 are shown schematically in FIG. 16B. (FIGS. 16A and 16B should be interpreted in conjunction with FIGS. 9, 17, 18 and 19E.) When the tiller rod 41 is pulled toward the port side of the stern deck beam, the stern hulls 6B and 6C rotate counter-clockwise as viewed from above the deck. This can be deduced from careful examination of FIGS. 16A, 6 and 20. The stern hull tiller block 15 rides on the bottom "T" rail, under the stern deck bean 1C, as shown in FIG. 17 (which is a view looking upward), and is free to move a distance equivalent 70, 71, FIG. 16B, to a rotation of 20 degrees in the stern hulls from their equilibrium position before it impinges on the bow hull tiller block 14. The bow hull tiller block 14 is normally locked in position along the "T" rail 17C; see FIGS. 19A–19E. FIGS. 19A–19E show the stern tiller block 15 and the bow tiller block 14 mechanisms, and illustrate their operation.

FIG. 19A shows a cutaway view of the idealized cross sections of the tiller blocks. FIGS. 19B–19E illustrate the operational sequence. When the stern hull tiller block 15 impinges on the bow hull tiller block 14 in FIG. 19C it releases the mechanism which prohibits the motion of the bow hull tiller block 14 toward the port side of the stern deck beam. This operation will now be explained in detail. The mechanism illustrated in FIG. 19A on the stern hull tiller block 15 has an extensions 81 and 82 on either side thereof. When one of these extensions contact a respective lever arms 83 and 84, at the end of the travel of the tiller block 14, a respective springs (85 or 86) is compressed which raises a respective friction pad (87 or 88) off the surface of the "T" rail surface 17C. This allows the motion of the bow hull tiller block 14 in the same direction as the stern hull tiller block 15 is moving. In this case, the extension 82 depresses the lever arm 84, raising the friction pad 88. The bow hull tiller block 14 is now free to move toward the port side of the stern deck beam. The other friction pad 87 merely slides along the "T" rail, since it cannot exhibit its jam cleat-like action for this direction of travel. Now continued pulling on the tiller rod will rotate both the stern and the bow tiller blocks, FIG. 19C, and hence the stern hulls and the bow hull. In this condition, the stern hulls are 20 degrees ahead of the bow hull rotation in the counter-clockwise direction (as viewed down onto the deck triangle). When the main tiller block 43 is at the end of its travel near the port vertex, FIG. 19D, the bow hull 6A in FIG. 1 will be in its new equilibrium position for a port tack; see FIG. 20. The stern hulls 6B and 6C will overshoot their equilibrium positions for this tack and will have to be rotated back in a clockwise direction for 20 degrees, as shown in FIG. 19E. As the stern hull tiller block 15 moves the stern hulls clockwise, the bow hull tiller block 14 mechanism once again locks onto the "T" rail. Note that the helmsman is now located near the port vertex with the tiller rod, and his weight helps offset the capsizing moment of the wind load on the sail. FIG. 18 shows a realistic drawing of the tiller block mechanisms, while FIG. 17 shows a realistic view of the underside of the stern deck beam with the steering mechanisms appended.

Returning to FIG. 16A, the cables 36$C_3$ and 36$B_3$ go to the respective stern vertices dagger boards and control their elevation as a function of the bow hull tiller block 14 orientation. Cable 36A goes to the bow hull pulley 35A in FIG. 3A. The stern hull tiller block 15 is permitted to move through a lateral displacement equivalent to a rotation of $\pm 20°$ about the nominal position of the hull 6A before the bow hull tiller block 14 is unlocked from the "T" rail 19C, see FIG. 13B. This rotation is considered adequate to steer the sailboat 101. The bow hull tiller block 14 is connected to the bow hull control pulley 35A by cable 36A, as above indicated. The bow hull tiller block 14 is also connected to the port and starboard shaft assembly dagger board elevation control 36$C_3$ and 36$B_3$, respectively. Thus, when the port hull 6C is in the outrigger position, its dagger board is raised to reduce drag, while the starboard hull dagger board is fully inserted. The opposite situation exists when the sailboad in on a starboard tack. When the sailboat 103 is running before the wind, both stern dagger boards are at the half inserted position. Additional cables 34, 36$C_4$, 36$B_4$ allow any or all the dagger boards to be retracted fully, independent of the tiller position, so that the sailboat can be readily beached, without damage, or trimmed as desired.

The three hulls 6A–6C of the sailboat 101 are identical; therefore, the description below (with reference to FIGS. 10A–10C) applies to all three. The hull in FIG. 10B is marked 6A. Although the hull 6A can be made of any suitable material, it will be assumed here that it is made of fiberglass. The hull form is basically a shallow draft planing type, somewhat similar to a kayak. A fiberglass well 72 is bolted into an opening 73 in the top of the hull. The wall 72 contains the pillow blocks 74A and 74B which hold the shaft assembly hinge pins 32A in FIG. 3A. These pillow blocks have low friction plastic liners which do not require external lubrication. The bottom of the well 72 is designed to distribute the shaft assembly load over a large area of the bottom of the hull. The well 72 also has a slit 181 through which the shaft assembly dagger board passes through when it is inserted. The slit is of sufficient width and length to allow the dagger board free motion without binding under all orientations of the hull and elevations of the dagger board. Some water will enter the well 72 when the sailboat 103 is in the water. The remainder of the hull volume is filled with plastic foam to provide buoyancy, even if the hull is damaged. The rotation of the hull about the hinge pin 32A is limited by cables 75 and 76 attached between the bow and the shaft assembly, and between the stern and the shaft assembly. The bow cable length is set so that the stern section of the hull is prevented from impinging on the deck beams or the deck trampoline. It also prevents the hull from tilting downward so that the bow of the hull is lower than the stern of the hull. The length of the stern cable 76 is set to prevent the bow of the hull 6A in FIG. 10B from lifting too high in going over a wave, which would put excessive load on the hull (See the angle $\gamma$ in FIG. 10B). The bow cable 75 can also be adjusted in length to permit the hull 6A to rest in the water at the optimum planing angle for the existing sea conditions. Adjustment devices shown 77 and 78 in FIG. 10B, for the bow and stern cables are mounted on the shaft assembly of the dagger board 33A.

Further modifications of the invention herein disclosed will occur to persons skilled in the art and all such modifications are deemed to be within the scope of the invention as defined by the appended claims.

What is claimed is:

1. A sailboat adapted to sail on water in a sailing direction that comprises, in combination:

three rigid beams that form the sides of a triangle having a generally horizontal orientation, an integral, rigid mast that extends between top and foot ends and disposed substantially orthogonal to the plane of the triangle, the foot end of the mast being disposed within the perimeter of the triangle and piercing the plane of the triangle, a plurality of cables extending from each vertex of said triangle to said top and foot ends of said mast, the ones of said cables extending to the foot of said mast lying below the plane of said triangle, said cables being stretched to support the mast in said orthogonal orientation as well as to render a space frame defined by said beams, mast and cables rigid;

three hulls positioned respectively at the three vertices of the triangle, and means for mounting said hulls to said vertices so that they each are rotatable about both a first axis generally parallel to the plane of said triangle and generally perpendicular to the sailing direction and a second axis raked backwardly from the sailing direction and from a normal to said triangle by an angle $\alpha$.

2. A sailboat as claimed in claim 1, further comprising a tiller and means for connecting said tiller to said mounting means to control the orientation of said hulls with respect to said second axis to thereby control the sailing direction while at the same time orientating said hulls with respect to the water to resist leeward slippage and to promote efficient planing.

3. A sailboat as claimed in claim 2, wherein each of the hulls has a dagger board which can be inserted and retracted.

4. A sailboat as claimed in claim 3, wherein the tiller is connected to insert and retract two of the dagger boards selectively.

5. A sailboat as claimed in claim 2 wherein the tiller is operable to control directly the horizontal orientation of two of the hulls as a continuous function of tiller movement.

6. A sailboat as claimed in claim 5 wherein the third hull is controlled by the tiller only after a finite rotation, relative to an initial orientation has occurred in the stern hulls relative to the all-hulls parallel initial sequence condition.

7. A sailboat as claimed in claim 6 wherein said finite rotation is greater than about 20 mechanical degrees.

8. A sailboat as claimed in claim 1 further comprising turnbuckle means wherein said cables are connected to said turnbuckle means to apply tension to said cables to render said space frame rigid.

9. A sailboat as claimed in claim 9 wherein said turnbuckle means is a single turnbuckle.

10. A sailboat as claimed in claim 1 having means associated with each hull to limit rotation thereof about said first axis.

11. A sailboat according to claim 10 wherein said limiting means is adjustable to provide an angle of orientation that is an optimal placing angle for a given water condition.

12. A sailboat as claimed in claim 11 having a seat connected to the one of said beams which forms the stern of the boat and adapted to slide from side-to-side as well as to be secured at intermediate transverse locations.

13. A sailboat according to claim 12 wherein said seat is operatively coupled to said tiller so that movement of said seat along said stern beam controls the sailing direction and automatically positions said seat for a weight distribution on the sailboat that resists capsizing.

14. A sailboat as claimed in claim 1 further comprising first fittings to receive said beams, and second fittings at each of the head and the foot of the mast to receive said cables, said first and second fittings and said hull mounting means being adapted to permit facile assembly and disassembly of the sailboat.

15. A sailboat as claimed in claim 1 wherein said mast and said beams are aluminum tubes.

16. A sailboat as claimed in claim 1 further comprising a main sail with a boom sufficiently short to pivot within the confines of the space frame without striking said cables.

17. A sailboat comprising:

a tetrahedral-type space frame that includes a triangular deck beam structure, a mast oriented substantially orthogonal to the plane of the triangular deck beam structure and extending outward from one side of said plane, one end of the mast piercing said plane, three stays connecting the outward end of the mast respectively to the deck beam structure at the three vertices of the triangular structure, and three further stays connecting said one end of the mast respectively to said three vertices;

three hulls secured to the triangular deck beam structure, one hull at each vertex of the structure extending away from said plane at the side of the triangular deck beam structure opposite that side from which the mast extends, means for mounting said hulls to said vertices so that they each are rotatable about both a first axis generally parallel to the plane of said triangular beam structure and generally perpendicular to the sailing direction and a second axis raked backwardly from the sailing direction and from a normal to said triangular beam structure by an angle $\alpha$, a tiller, means for connecting said tiller to said mounting means to control the orientation of said hulls with respect to said second axis to thereby control the sailing direction while at the same time orientating said hulls with respect to the water to resist leeward slippage and to promote efficient planing, and a seat connected to one of said beams which forms the stern of the boat and adapted to slide from side-to-side as well as to be secured at intermediate transverse locations, said seat being operatively coupled to said tiller so that movement of said seat along said stern beam controls the sailing direction and automatically positions said seat for an effective weight distribution on the sailboat.

18. A sailboat as claimed in claim 17 in which said connecting means comprises tiller cable means and pulley means interconnected with the three hulls in appropriate fashion to convert linear movement of the tiller to rotational movement of the hulls.

19. A sailboat as claimed in claim 18 in which said connecting means includes a bow hull tiller block connected by the cable means to the bow hull, which bow hull tiller block is moved along the stern deck beam of the triangular deck beam structure.

20. A sailboat kit having component parts capable of being assembled in the field comprising, when assembled, a tetrahedral-type spaceframe having a triangular deck beam structure, a mast oriented substantially orthogonal to the plane of the triangular deck beam structure and extending outward from one side of said plane, one end of the mast piercing said plane, three stays connecting the outward end of the mast to the triangular deck beam structure respectively at the three vertices thereof, three further stays connecting said one end of the mast respectively to said three vertices, and three hulls secured to the triangular deck beam structure, one hull being disposed at each vertex of the triangular deck beam structure and extending away from said plane at the side of the triangular deck beam structure opposite that from which the mast extends, and means for rotatably mounting said hulls to said vertices for rotation about a first axis parallel to the plane of said triangular beam structure and generally perpendicular to the sailing direction and about a second axis raked backwardly from the sailing direction and from a normal to said triangular beam structure by an angle $\alpha$.

* * * * *